US007737616B2

(12) United States Patent
Takegami

(10) Patent No.: US 7,737,616 B2
(45) Date of Patent: Jun. 15, 2010

(54) ELECTRON-EMITTING DEVICE, ELECTRON SOURCE, IMAGE DISPLAY APPARATUS AND TELEVISION APPARATUS

(75) Inventor: Tsuyoshi Takegami, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 523 days.

(21) Appl. No.: 11/682,102

(22) Filed: Mar. 5, 2007

(65) Prior Publication Data

US 2007/0216284 A1 Sep. 20, 2007

(30) Foreign Application Priority Data

Mar. 14, 2006 (JP) ..... 2006-068877

(51) Int. Cl.
*H01J 1/62* (2006.01)

(52) U.S. Cl. ..... 313/495; 313/496; 313/497; 445/24; 445/25

(58) Field of Classification Search ..... 313/495–497, 313/309–311; 445/24–25; 216/24–25
See application file for complete search history.

(56) References Cited

U.S. PATENT DOCUMENTS 5,578,225 A * 11/1996 Chien ..... 216/24
5,773,834 A 6/1998 Yamamoto et al. ..... 250/423 F
6,472,802 B1 * 10/2002 Choi et al. ..... 313/309
2002/0008482 A1 * 1/2002 Konuma ..... 315/169.3
2003/0042842 A1 * 3/2003 Cha et al. ..... 313/495

FOREIGN PATENT DOCUMENTS

| | | |
|---|---|---|
| JP | 9-221309 | 8/1997 |
| JP | 10-12124 | 1/1998 |
| JP | 2000-86216 | 3/2000 |
| JP | 2000-353467 | 12/2000 |

* cited by examiner

*Primary Examiner*—Nimeshkumar D. Patel
*Assistant Examiner*—Mary Ellen Bowman
(74) *Attorney, Agent, or Firm*—Fitzpatrick, Cella, Harper & Scinto

(57) ABSTRACT

An electron-emitting device comprises: (A) a first electrode; (B) an electron-emitting film which is provided on the first electrode; and (C) a second electrode which is provided above the electron-emitting film across a distance H from the electron-emitting film, and includes an opening which exposes at least a part of the electron-emitting film, wherein an area of the second electrode is at least four times larger than an area of the opening, and a ratio H/W of the distance H to a width W of the opening is not less than 0.07 but not more than 0.6.

24 Claims, 17 Drawing Sheets

ELECTRON-EMITTING DEVICE, ELECTRON SOURCE, IMAGE DISPLAY APPARATUS AND TELEVISION APPARATUS

BACKGROUND OF THE INVENTION

1. Field of the Invention

The present invention relates to an electron-emitting device, an electron source, an image display apparatus and a television apparatus.

2. Description of the Related Art

FE (field emission) type electron-emitting devices are getting attention as devices which emits an electron from a metal surface, by applying an intense electric field of $10^6$V/cm or greater to the metal.

FIG. 15 is an exemplary diagram of a Spindt-type electron-emitting device as an example of the FE-type electron emitting device. In FIG. 15, the Spindt-type electron-emitting device includes a substrate 111, a gate electrode 112, a cathode electrode 113, an insulating layer 114 and an emitter 115. In the Spindt-type electron-emitting device, electric field concentration occurs on the tip of the sharpened emitter 115 so as to emit an electron, upon application of a positive voltage higher than that of the emitter 115 to the gate electrode.

As other structures, Patent document 1 (Japanese Patent Application Laid-Open (JP-A) No. HEI9-221309) discloses an electron-emitting device including a carbon fiber (e.g. a carbon nano-tube, etc.) used for the emitter. Patent document 2 (JP-A No. 2000-353467) discloses an electron-emitting device including diamond or diamond-like carbon (DLC). FIG. 16 is a diagram showing an electron-emitting device for performing electron emission, upon giving of an appropriate positive level of potential to an electrode 212 facing an emitter electrode 211.

Patent documents 3 and 4 disclose an electron-emitting device wherein a carbon nano-tube is formed in a small hole. FIG. 17 is a diagram showing the example wherein a carbon nano-tube 315 is formed in the small hole (Patent document 4).

[Patent document 1] JP-A No. HEI9-221309 (U.S. Pat. No. 5,773,834 A)

[Patent document 2] JP-A No. 2000-353467

[Patent document 3] JP-A No. HEI10-12124

[Patent document 4] JP-A No. 2000-86216

SUMMARY OF THE INVENTION

However, in each of the above-described electron-emitting devices, there is a problem that it is difficult to lower a drive voltage for the electron-emitting device.

An object of the present invention is to provide an electron-emitting device in which the electron emission thereof can be controlled by a low drive voltage (swing voltage).

(1) According to a first aspect of the invention, there is provided an electron-emitting device comprising: (A) a first electrode; (B) an electron-emitting film which is provided on the first electrode; and (C) a second electrode which is provided above the electron-emitting film at a distance H from the electron-emitting film, and includes an opening which exposes at least a part of the electron-emitting film, wherein an area of the second electrode is at least four times larger than an area of the opening, and a ratio H/W of the distance H to a width W of the opening is not less than 0.07 but not more than 0.6. In one example embodiment, the mentioned distance H is a distance from an upper surface of the electron-emitting film to the second electrode, and that distance is also further identified herein as distance H1.

(2) According to a second aspect of the invention, there is provided an electron-emitting device comprising: (A) a first electrode; (B) a plurality of electron emitters which are provided on the first electrode; and (C) a second electrode which is provided above the first electrode at a distance H from the first electrode, and includes an opening which exposes at least a part of the first electrode and at least a part of the plurality of electron emitters, wherein an area of the second electrode is at least four times larger than an area of the opening, and a ratio H/W of the distance H to a width W of the opening is not less than 0.07 but not more than 0.6. In one example embodiment, this distance H is a distance from an upper surface of the first electrode to the second electrode, and is also further identified herein as distance H2.

(3) According to a third aspect of the invention, there is provided an electron source comprising: a plurality of electron-emitting devices; and a wiring for commonly connecting the plurality of electron-emitting devices, wherein each of the electron-emitting devices is the electron-emitting device according to (1) or (2).

(4) According to a fourth aspect of the invention, there is provided an image display apparatus comprising: the electron source according to (3); a third electrode which faces the electron source; and a luminescent member which is arranged on a side of the third electrode.

(5) According to a fifth aspect of the invention, there is provided a television apparatus comprising: the image display apparatus according to (4); and a receiving unit which receives a television signal and outputs image data to the image display apparatus.

According to the present invention, the electron can be controlled at a low drive voltage (swing voltage).

Further features of the present invention will become apparent from the following description of exemplary embodiments with reference to the attached drawings.

DESCRIPTION OF THE EMBODIMENTS

Preferred embodiments of this invention will now specifically be described with reference to the drawings. The invention is not limited to the details of size, material, form and arrangement of the constituent components set forth in the following description. The invention is capable of being practiced or carried out in various ways in accordance with the structure or conditions of the applied apparatus. The embodiments are not intended to limit the scope of this invention.

Embodiment of A Television Apparatus

Figure 13:
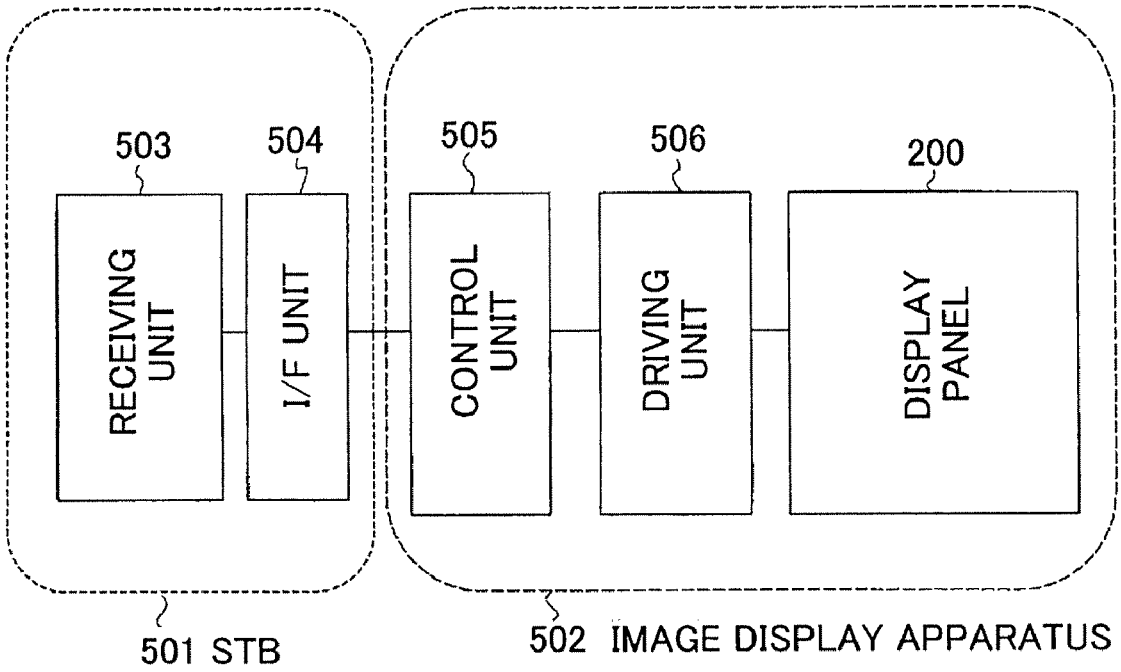
FIG. 13 is a block diagram of a television apparatus.

FIG. 13 is a diagram for explaining a television apparatus as a typical example of an image display apparatus including an electron-emitting device of the present invention applied thereto. FIG. 13 is a block diagram of a television apparatus according to the present invention. The television apparatus includes a set top box (STB) 501 and an image display apparatus 502.

The set top box (STB) 501 includes a receiving unit 503 and an I/F unit 504. The receiving unit 503 includes a tuner, a decoder, etc., receives a TV signal (such as a satellite broadcast or terrestrial broadcast, etc.) and a data broadcast through a network, and outputs decoded video data to the I/F unit 504. The I/F unit 504 transforms the video data into a display format corresponding to the image display apparatus 502, and outputs the image data to the image display apparatus 502.

Figure 14:
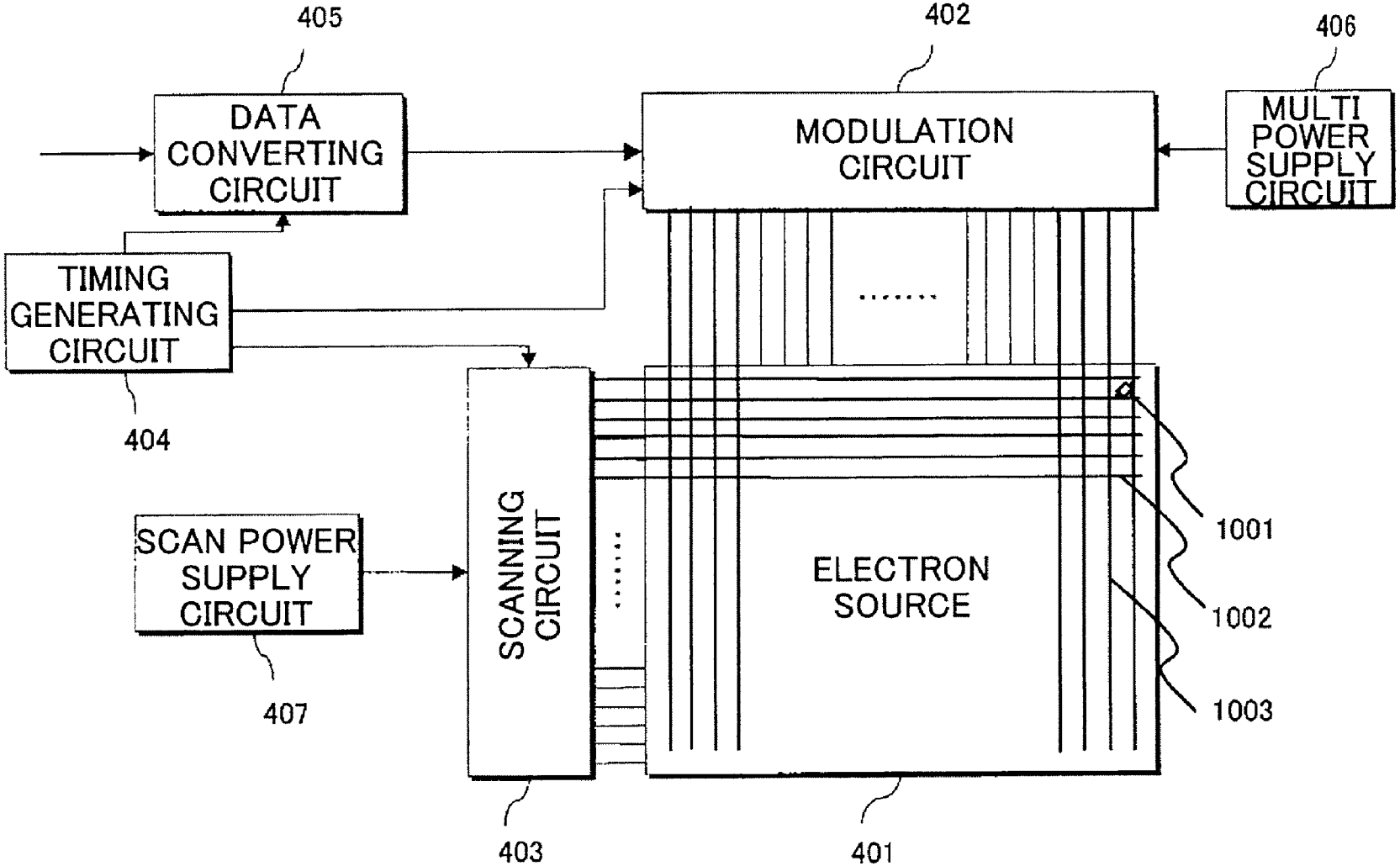
FIG. 14 is a block diagram of an image display apparatus.
Figure 15:
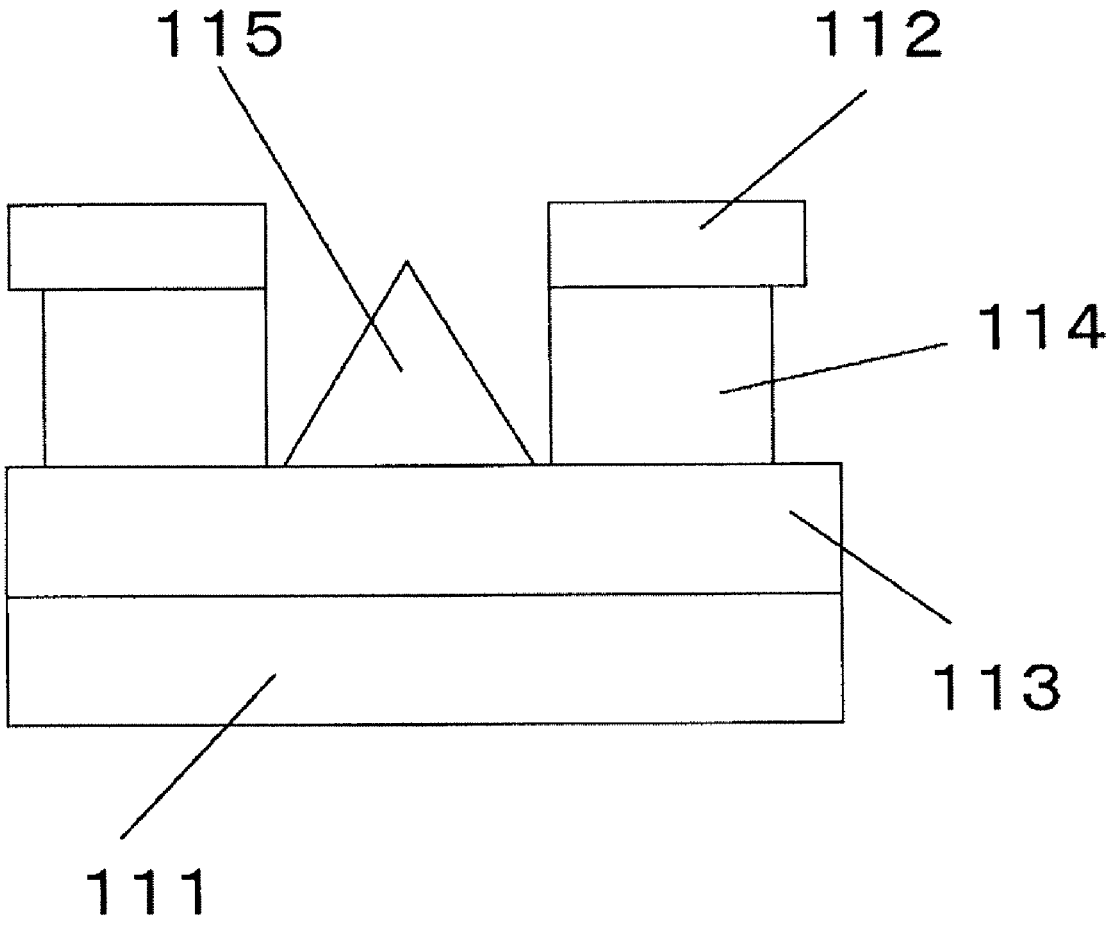
FIG. 15 is an exemplary diagram of a Spindt-type electron-emitting device as an example of an FE-type electron-emitting device.
Figure 16:
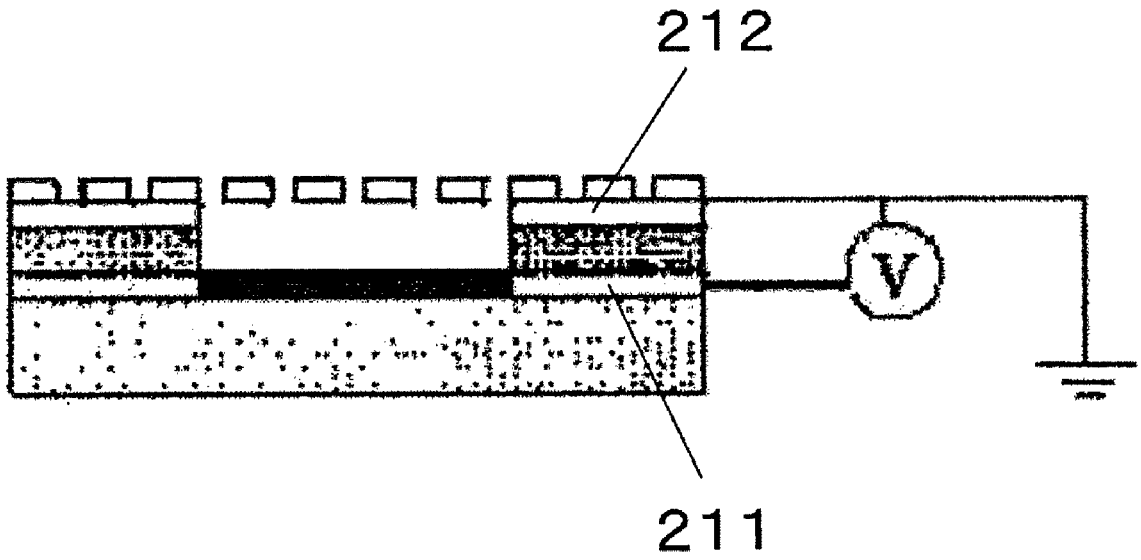
FIG. 16 is a diagram showing an electron-emitting device which emits an electron by providing an appropriate positive potential to an electrode 212 facing an emitter electrode 211.
Figure 17:
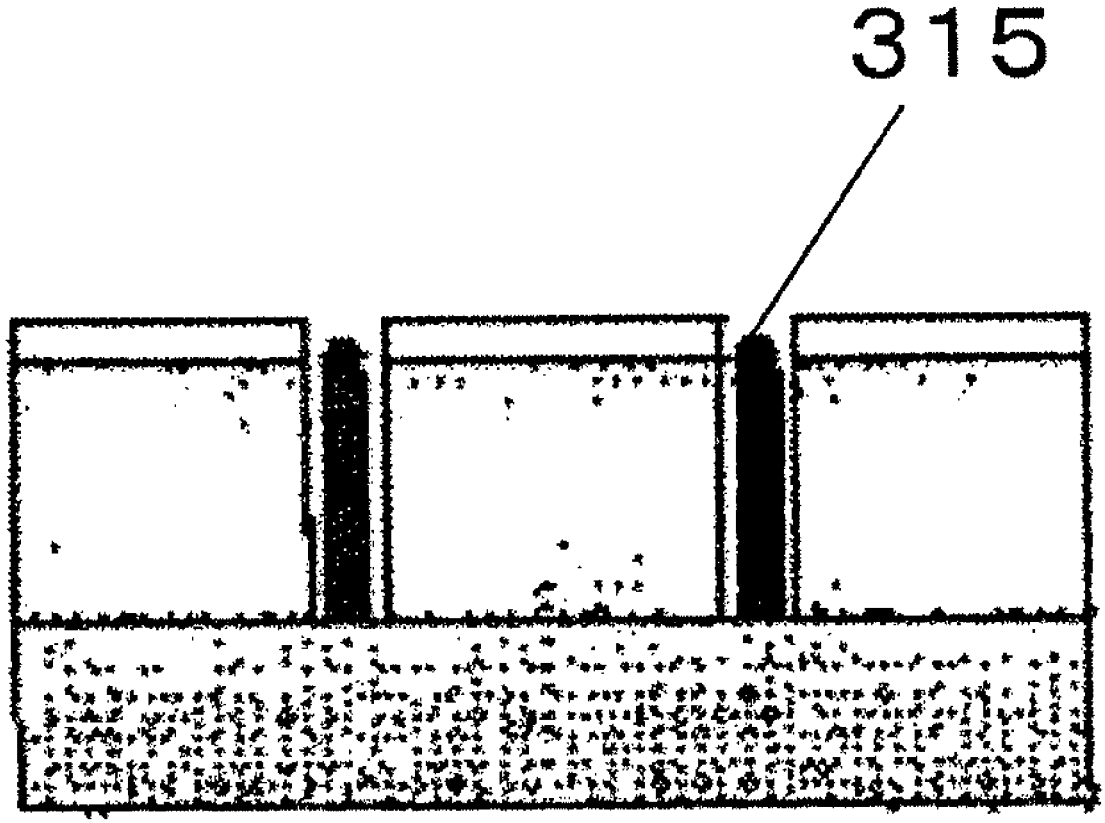
FIG. 17 is a diagram showing an example of a carbon nano-tube 315 formed in a small hole.

The image display apparatus 502 includes a display panel 200, a control unit 505 and a driving unit 506. The control unit 505 of the image display apparatus 502 performs image processing (e.g. a correction process) for the input image data in a way corresponding to the display panel 200, and outputs the image data and various control signals to the driving unit 506. The driving unit 506 outputs a driving signal to the display panel 200 based on the input image data so as to display a TV image on the display panel 200. The driving unit 506 includes, for example, a modulation circuit 402 and a scanning circuit 403 as shown in FIG. 14. The display panel 200 includes an electron source 401 in this embodiment, as shown in FIG. 14.

Note that the receiving unit 503 and the I/F unit 504 may be separated from the image display apparatus 502 and contained in another casing in the form of the STB 501, or may be contained in the same casing as that of the image display apparatus 502.

FIG. 14 shows an example of the driving unit for driving the electron source 401 included in the display panel 200 of FIG. 13. The driving unit includes the modulation circuit 402, the scanning circuit 403, a timing generating circuit 404, a data converting circuit 405, a multi power supply circuit 407 and a scan power supply circuit 408.

The electron source 401 is formed of a plurality of electron-emitting devices 1001 as will be described later. Each of the electron-emitting devices 1001 emits an electron toward a luminescent member facing the electron source 401 so as to emit light. The light generated by the plurality of electron-emitting devices builds up a display image. The brightness of the light can be controlled by an amount of electron irradiation by the electron-emitting device. The amount of the electron irradiation by the electron-emitting device can be controlled by the magnitude of a voltage applied to the electron-emitting device or its voltage application period. Thus, a desired amount of emitted electrons can be controlled by controlling a potential difference between a potential of a scan signal output from the scanning circuit 403 and a potential of a modulation signal output from the modulation circuit 402, or by controlling an application period of the modulation signal within the application period of the scan signal.

The electron source 401 includes a plurality of scan wirings 1002 and a plurality of modulation wirings 1003 for matrix driving the plurality of electron-emitting devices 1001. The scan signal is applied to the scan wiring 1002, and the modulation signal is applied to the modulation wiring 1003.

The modulation circuit 402 is connected to column wirings 1003 as the modulation wirings of the electron source 401. This modulation circuit 402 receives PHM (Pulse Height Modulation) data and PWM (Pulse Width Modulation) data which is pulse width data (timing data) input thereto. The modulation circuit 402 receives the PHM data and the PWM data which are input by the data converting circuit 405 as an output circuit. The modulation circuit 402 generates the modulation signal in accordance with the input modulation data. The modulation circuit 402 functions as modulation means for providing a modulation signal modulated based on the modulation data input from the data converting circuit 405, to the column wiring 1003 which is connected to each of electron-emitting devices.

The scanning circuit 403 is connected to row wirings 1002 as the scan wirings of the electron source 401. The scanning circuit 403 provides a selection signal (scan signal) to the scan wiring 1002 to which the electron-emitting devices to be driven are connected. Generally, progressive scan for successively selecting the scan wiring one at a time is performed. However, the present invention is not limited to such an embodiment, interlace scan can also be performed, or multi lines can be selected at a time. The scanning circuit 403 functions as row selection means for providing a selection potential at a predetermined time and a non-selection potential at any other time to the row wiring connected to the plurality of electron-emitting devices to be driven, of the plurality of electron-emitting devices included in the electron source 401.

The timing generating circuit 404 generates timing signals for the modulation circuit 402, the scanning circuit 403 and the data converting circuit 405.

The data converting circuit 405 performs data conversion for converting gradation data (luminance data) into a driving waveform data format suitable for the modulation circuit 402. Note that this gradation data externally inputted represents the required brightness to be realized by the electron source 401.

Below describes electron-emitting devices according to embodiments of the present invention that can preferably be used for an image display apparatus, such as the television apparatus, etc.

First Embodiment of Electron-Emitting Device

Figure 1B:
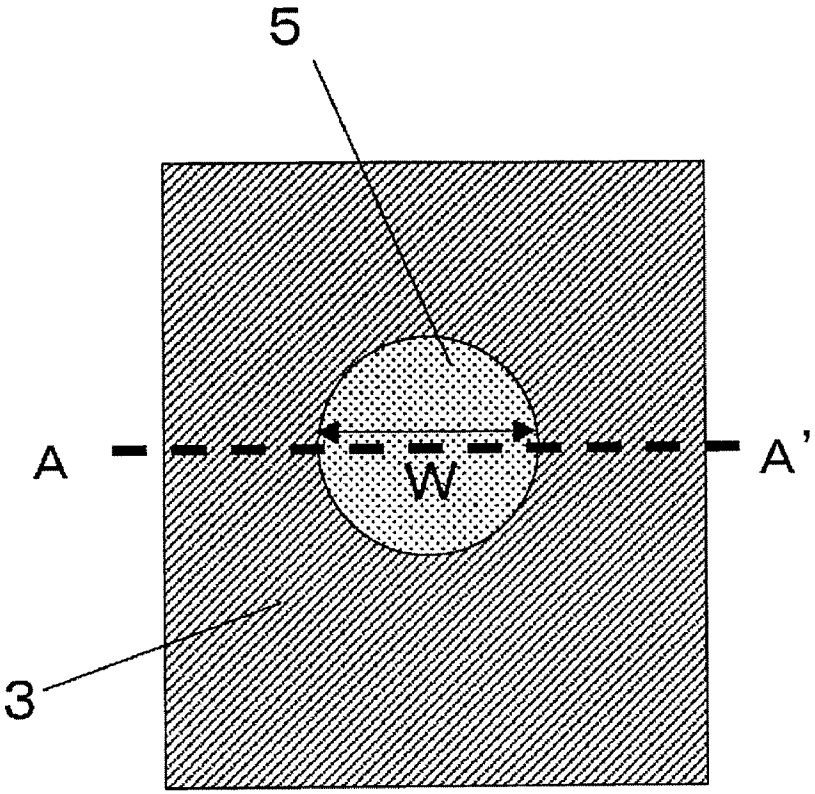
FIG. 1B is a plan view exemplarily showing the structure of the electron-emitting device.
Figure 1A:
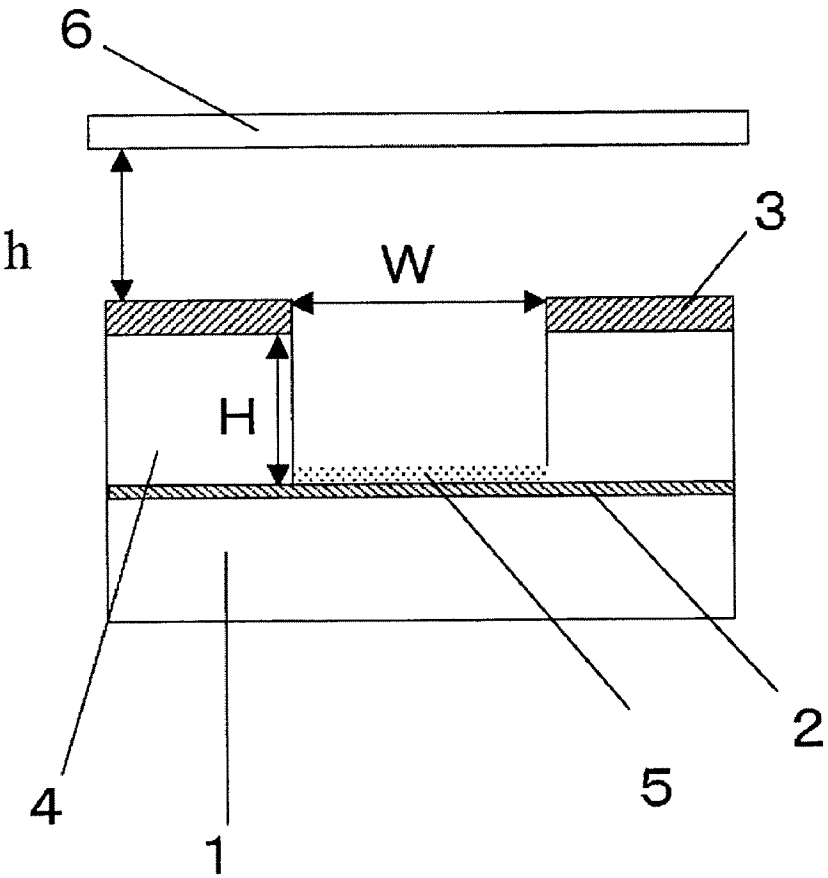
FIG. 1A is a cross sectional view exemplarily showing a structure of an electron-emitting device according to a first embodiment.

FIG. 1A and FIG. 1B are exemplary diagrams showing the structure of the electron-emitting device according to the first embodiment. FIG. 1A shows a schematic cross sectional view of the device, while FIG. 1B shows a schematic plan view thereof. FIG. 1A is a cross sectional view taken along a line A-A' of FIG. 1B.

In FIG. 1A and FIG. 1B, the electron-emitting device includes a substrate (base member) 1, a first electrode 2 which is a cathode electrode, a second electrode 3 which is a gate electrode, an insulating layer 4 formed between the first and second electrodes 2 and 3, and an electron-emitting member 5 which emits an electron. In this embodiment, the second electrode 3 has a circular opening with a width of "W" (diameter of the circle). The third electrode 6 which is an anode electrode is disposed at a distance "h" from the second electrode 3 of the electron-emitting device. A selection signal output from the scanning circuit 403 is applied to the first electrode 2. A modulation signal output from the modulation circuit 402 is applied to the second electrode 3. In this embodiment, the electron-emitting member 5 is arranged only underneath the opening formed in the second electrode 3. In other words, in this embodiment, the electron-emitting member 5 is arranged substantially in a range of the orthogonal projection of the opening. Note that the electron-emitting member 5 may be formed in a more inward position than the orthogonal projection range of the opening.

The second electrode 3 is disposed above the substrate 1 at a distance "H" from the first electrode 2 arranged on the substrate 1. The opening formed in the second electrode 3 exposes the electron-emitting member 5 formed on the first electrode 2. In this embodiment, the insulating layer 4 is formed between the first electrode 2 and the second electrode 3, and has a thickness corresponding to the distance "H". In the example of FIG. 1A, the insulating layer 4 has an opening communicating with the opening of the second electrode 3 and having substantially the same diameter as the diameter of the opening of the second electrode 3. In one example embodiment, this distance H is a distance from an upper surface of the first electrode to the second electrode, and is also further identified herein as distance H2.

It is not necessary that the opening of the insulating layer 4 have the same diameter as that of the opening of the second electrode 3. Such an electron-emitting device, which includes the second electrode 3 with the opening communicating with that of the insulating layer 4, can be expressed as an electron-emitting device which includes an opening penetrating the second electrode 3 and the insulating layer 4. It can be expressed that the electron-emitting member 5 is arranged inside the opening which includes the opening of the insulating layer 4 and the opening of the second electrode 3.

Including this embodiment, the insulating layer 4 is not necessarily formed in the electron-emitting device of the present invention. However, the insulating layer 4 is preferably formed so as to reduce an amount of emitted electrons reaching the second electrode 3, of those electrons emitted from the electron-emitting device 5.

Note that a symbol Sc denotes the area of a part of the first electrode 2 which is right underneath the opening (namely "the area of the opening of the second electrode 3"), and a symbol Sg denotes the area of the second electrode 3. In the electron-emitting device of this embodiment, the area Sg of the second electrode 3 is at least four times larger than the area Sc of the opening, and a ratio H/W of the distance H to the width W of the opening is not less than 0.07 but not more than 0.6, that is, between 0.07 and 0.6. Such an electron-emitting device satisfying this relationship requires only a low level of swing voltage for controlling between the On-state and the Off-state. Note that the areas Sc and Sg correspond to the areas of the electrodes when the second electrode 3 is viewed from the side of the anode electrode 6 shown in FIG. 1A (i.e. those areas in the top view of FIG. 1B).

The opening of the second electrode 3 in the electron-emitting device of the present invention is not limited to have the above-described circular form, and may have any other desired form, other than this embodiment. For example, the opening may have a square, rectangular, polygonal or oval form. When the opening has an oval form, the minor diameter thereof corresponds to "W".

When the opening has a rectangular form, the short-side direction of the opening of the second electrode 3 has a dimension, called a "width of the opening", while the longitudinal direction thereof has a dimension, called "length of the opening". When the opening has an oval form, the dimension of the minor axis (minor diameter) is called "width of the opening", while the dimension of the major axis (major diameter) is called "length of the opening". Note that the "width of the opening" corresponds to the above described width "W".

Second Embodiment of Electron-Emitting Device

Figure 2B:
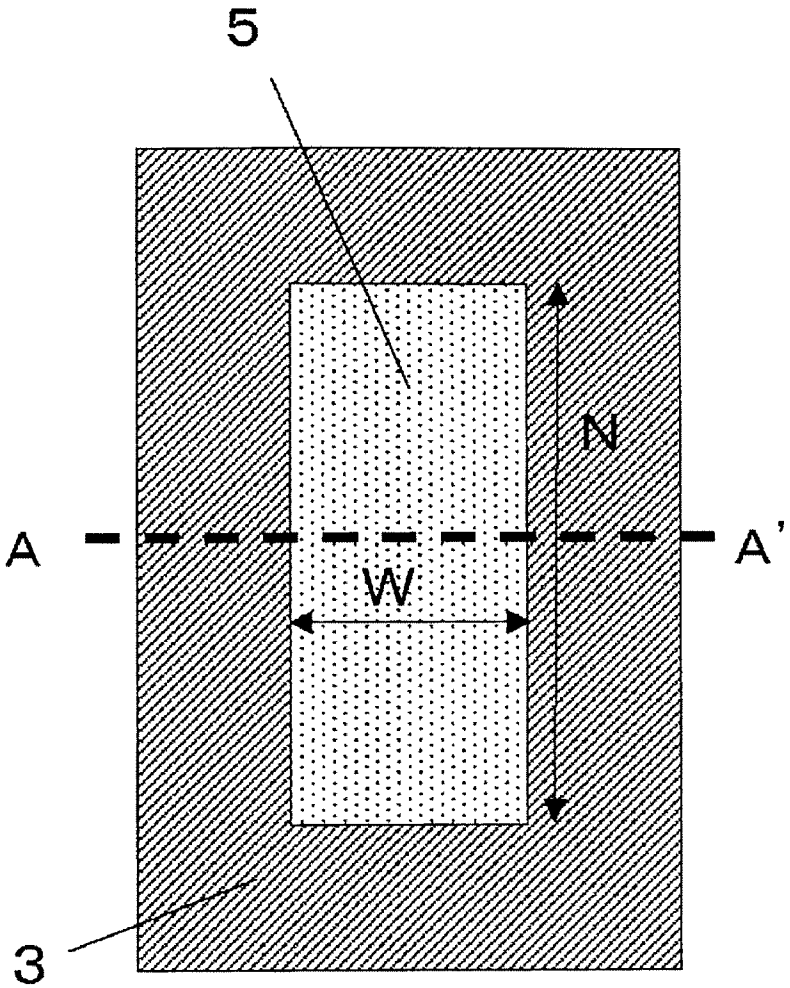
FIG. 2B is a plan view exemplarily showing the structure of the electron-emitting device.
Figure 2A:
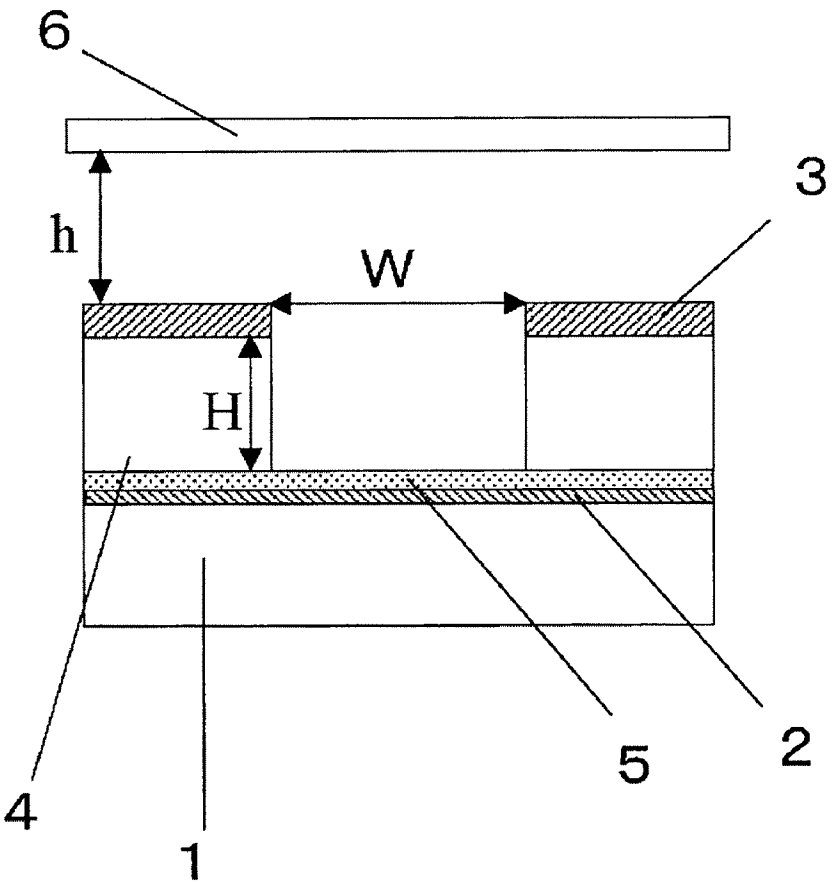
FIG. 2A is a cross sectional view exemplarily showing a structure of an electron-emitting device according to a second embodiment.

FIG. 2A and FIG. 2B are exemplary diagrams showing the structure of an electron-emitting device according to this embodiment. FIG. 2A shows a schematic cross sectional view of the device, and FIG. 2B shows a schematic plan view thereof. FIG. 2A is a cross sectional view taken along a line A-A' of FIG. 2B. The electron-emitting device shown in FIG. 2A and FIG. 2B has a rectangular form. Note that a symbol "W" denotes the width of its opening (corresponding to the dimension in the short-side direction). When the opening has a square form, its one length (width) corresponds to "W". Like the electron-emitting device of the first embodiment, the opening may have a circular or oval form.

In FIG. 2A and FIG. 2B, the use of the same symbols as those of FIG. 1A and FIG. 1B indicates the identical members, and the identical members are not repeatedly explained again, while only those different parts of the identical members are described. In the electron-emitting device of this embodiment also, a selection signal output from the scanning circuit 403 is applied to the first electrode 2, while a modulation signal output from the modulation circuit 402 is applied to the second electrode 3. In the second embodiment, the most different part from the first embodiment is that the electron-emitting member 5 is extended under not only the opening formed in the second electrode 3, but also under the second electrode 3 (under the insulating layer 4). That is, in the second embodiment, the electron-emitting member 5 is arranged substantially inside and outside a range of the orthogonal projection of the opening.

The second electrode 3 is disposed above the substrate 1 at a distance "H" from the electron-emitting member 5 formed on the first electrode 2. The opening formed in the second electrode 3 exposes the electron-emitting member 5 formed on the first electrode 2. In the example of FIG. 2A, the insulating layer 4 is disposed between the electron-emitting member 5 and the second electrode 3, and the thickness of the insulating layer 4 corresponds to the above-described distance "H". The electron-emitting device shown in FIG. 2A includes an opening penetrating the second electrode 3 and the insulating layer 4. However, the insulating layer 4 is not necessarily formed in the electron-emitting device of this embodiment, as described in the first embodiment. In one example embodiment, this distance H is a distance from an upper surface of the electron-emitting member to the second electrode, and that distance is also further identified herein as distance H1.

Like this embodiment, if the electron-emitting member 5 is arranged right underneath the second electrode 3, one problem is that electrons flow to the second electrode 3 from the electron-emitting member 5 rather than the electron-emitting device of the first embodiment. Hence, it is preferred that the electron-emitting member 5 right underneath the second electrode 3 be covered with the insulating layer 4.

In the electron-emitting device of this embodiment, the area of the second electrode 3 is referred to as "Sg", and the area of the first electrode 2 in the opening (area of a part of the first electrode 2 right underneath the opening of the second electrode 3) is referred to as "Sc". In the electron-emitting device of this embodiment, the area Sg of the second electrode 3 is at least four times larger than the area Sc of the opening, and the ratio H/W of the distance H to the width W of the opening is not less than 0.07 but not more than 0.6. Thus formed electron-emitting device requires only a low level of swing voltage for controlling between the On-state and the Off-state. The description will be given more specifically later.

<About Distance H>

In the electron-emitting device of the first embodiment, the distance between the first electrode 2 and the second electrode 3 is defined as the distance H. In an electron-emitting device of the second embodiment, the distance between the electron-emitting member 5 and the second electrode 3 is defined as the distance H. However, which distance is defined as the distance H depends on the form of the electron-emitting member 5.

For example, the former distance is defined as the distance H, when a low density electron-emitting member 5 is used and its thickness can not be determined. That is, when the low density electron-emitting member 5 is arranged on the first electrode 2, the distance H can be defined as a distance (corresponding to the thickness of the insulating layer 4) between the first electrode 2 and the second electrode 3, like the first embodiment. In such a case, the electron-emitting member 5 arranged right underneath the opening is composed of a plurality of electron emitters. The former distance is defined as the distance H, when each of the electron emitters is arranged on the first electrode 2 at intervals (scattered or dispersed). It is not limited that the entire electron emitters are not in contact with each other. Even if a part of the plurality of electron emitters is in contact with each other, the former distance can be defined as "H", as long as the electron emitters are substantially dispersed.

Such electron emitters can, for example, be carbon fibers (carbon nano-tubes), conducting particles, etc.

That is, in a typical example of this case, a plurality of electron emitters are arranged on the surface of the first electrode 2, in a position right underneath the opening of the second electrode 3, and the surface of the first electrode 2 is exposed around the electron emitters. In other words, the plurality of electron emitters are arranged right underneath the opening, and the surface of the first electrode 2 right underneath the opening includes a part covered with the electron emitters and a part not covered therewith.

The latter distance is defined as the distance H, when the electron-emitting member 5 has a high density and can be considered as a film. That is, when the electron-emitting member 5 having a high density is formed on the first electrode 2, the distance between the electron-emitting member 5 and the second electrode 3 can be defined as the distance H, like the second embodiment. In other words, in such a case, typically, the electron-emitting member 5 is formed substantially of one single continuous film (electron-emitting film). That is, the electron-emitting film is formed right underneath the opening, and the surface of the first electrode 2 right underneath the opening is entirely or approximately entirely covered with the electron-emitting film.

The electron-emitting device of the second embodiment preferably includes the insulating layer 4 including an opening communicating with the opening of the second electrode 3, between the second electrode 3 and the first electrode 2. The electron-emitting film has a larger area than the area of the opening, and preferably exists both underneath the opening and between the insulating layer 4 and the first electrode 2 (or the substrate 1). According to this structure, an end of the electron-emitting film is not exposed in the opening, thus restraining emission of the electron from an end of the electron-emitting film and restraining diffusion of the electron beam.

In this manner, the usage of the definition (distance H) for either the former or latter distance depends on whether the area right underneath the opening of the second electrode 3 is practically covered with the electron-emitting member 5. In other words, the former distance is defined as the distance H, if the first electrode 2 is a member providing the lowest potential at the time of driving, of those members exposed into the opening including the opening of the insulating layer 4 and the opening of the second electrode 3. On the other hand, the latter distance is defined as the distance H, if the electron-emitting member provides the lowest potential at the time of driving (i.e. if the first electrode is covered substantially with the electron-emitting member), of those members exposed into the opening including the opening of the insulating layer 4 and the opening of the second electrode 3.

In the above-described electron-emitting device of the first embodiment, the former distance is defined as the distance H. However, if the electron-emitting member 5 includes a continuous film (electron-emitting film), the latter distance can be defined as the distance H. Similarly, in the electron-emitting device of the second embodiment, the latter distance is defined as the distance H. However, if the electron-emitting member 5 includes a plurality of scattered electron emitters, the former distance can be defined as the distance H.

<Driving of Electron-Emitting Device>

Below describes a swing voltage for controlling between the On-state and Off-state of the electron-emitting device of the present invention.

Figure 3B:
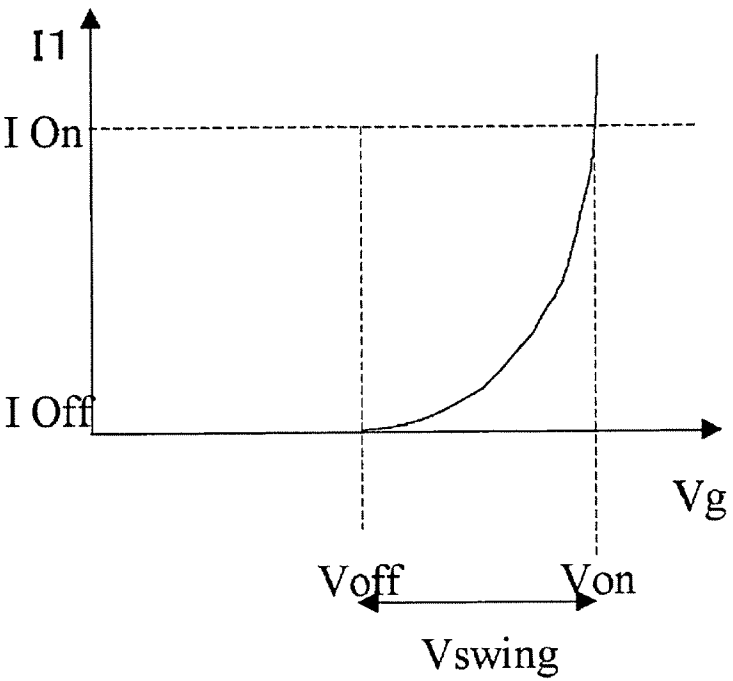
FIG. 3B is a diagram showing the relationship between the gate voltage Vg and the anode current I1.
Figure 3A:
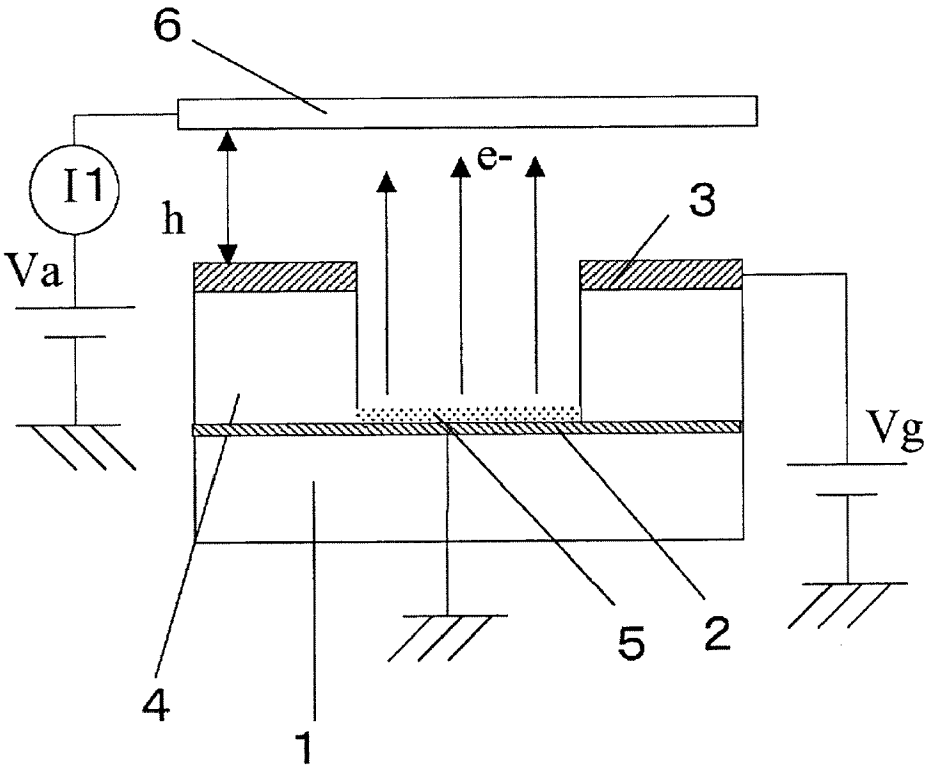
FIG. 3A is an exemplary diagram of an electron-emitting device that is connected to an electrical circuit.

FIG. 3A and FIG. 3B are diagrams exemplarily showing the driving of the electron-emitting device of the first embodiment described above. FIG. 3A is an exemplary diagram of the electron-emitting device connected to an electrical circuit, and FIG. 3B shows the relationship between the gate voltage Vg (voltage of the second electrode 3) and the anode current I1 (current of the third electrode 6). Hereinafter, the first electrode 2 is referred to as a cathode electrode 2, the second electrode 3 is referred to as a gate electrode 3 and the third electrode 6 is referred to as an anode electrode 6.

In the electron-emitting device of the present invention, electrons are emitted from the electron-emitting member 5 so as to obtain an emission current, when a positive voltage higher than that of the cathode electrode 2 is applied to the anode electrode 6 and the gate electrode 3. Thus, the voltage applied to the anode electrode 6 and the gate electrode 3 controls an amount of emitted electrons. When this electron-emitting device is used as an electron source for the display, the anode electrode 6 with luminescent members faces the plurality of electron-emitting devices. The luminescent member emits light upon collision of electrons. A plurality of luminescent members corresponding to the plurality of electron-emitting devices are formed. Typically, three luminescent members which emit different colors of light (R (red), G (green), B (blue)) form one pixel. For example, phosphors can be used as the luminescent member.

The brightness (luminance) of each pixel of the display can be adjusted by controlling an amount of electrons emitted to the luminance members. In order for the phosphors to emit sufficient light, practically, it is necessary to set the anode voltage to a high voltage (more specifically, in a range not less than 1 kV but not more than 30 kV). Hence, it is difficult to control the luminance by the anode voltage. A generally-adopted method is one for controlling the anode current using the voltage of the gate electrode 3.

FIG. 3B shows the relationship between the anode current I1 and the gate voltage Vg. In FIG. 3B, the anode voltage Va is set constant. The anode current I1 is controlled by the gate voltage Vg. The current Ion corresponds to a predetermined luminance (the maximum luminance) required for the image display apparatus, while the current Ioff corresponds to the minimum luminance (i.e. ideally, no light is emitted). A swing voltage Vswing (=Von−Voff) refers to a difference between the minimum value Voff and the maximum value Von of the gate voltage Vg, to be applied to the gate electrode 3 in order to obtain a luminance in a range from the minimum luminance to the predetermined luminance.

The magnitude of the swing voltage Vswing does not substantially change, even if the anode voltage Va is changed.

Figure 4:
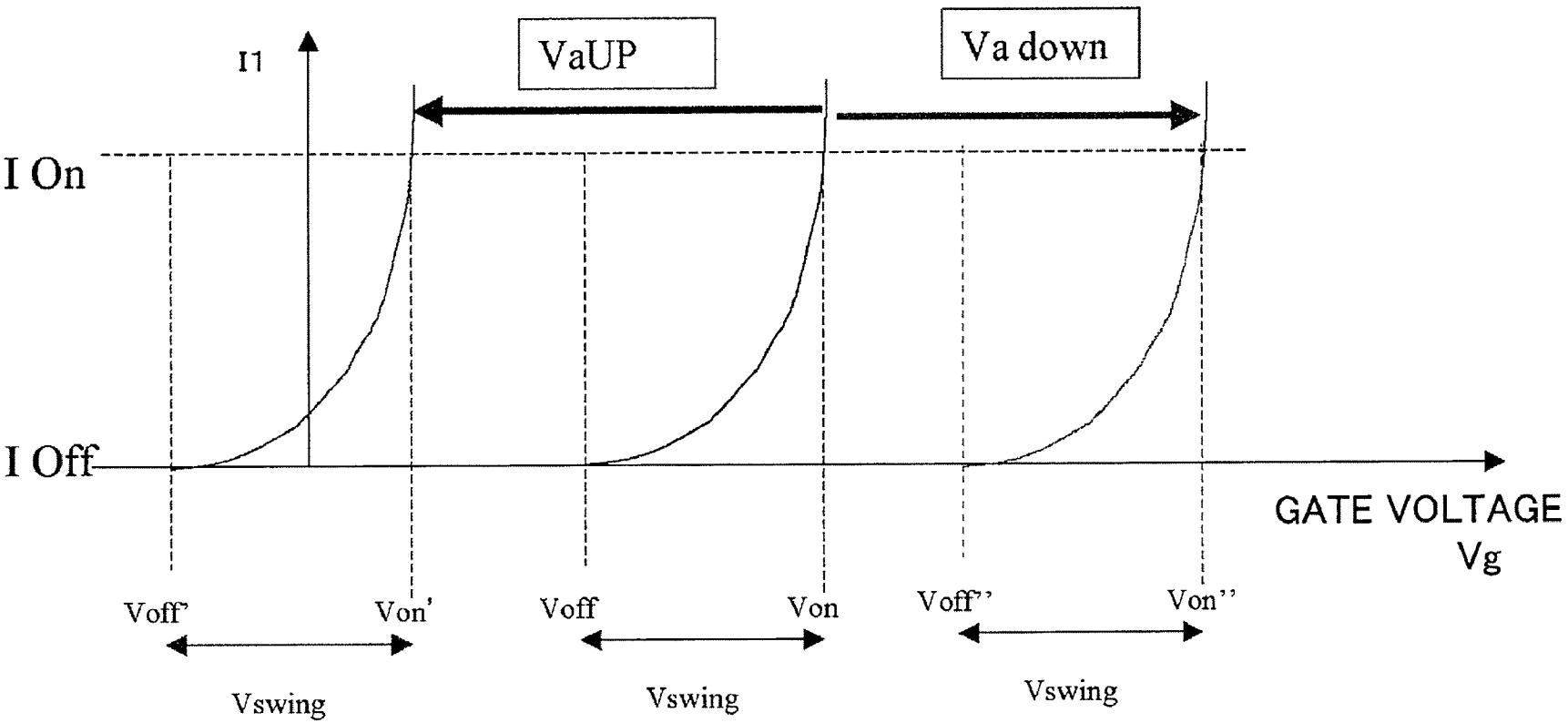
FIG. 4 is a diagram showing the relationship between the anode current I1 and the gate voltage Vg, when the anode voltage Va is changed.

FIG. 4 is an exemplary diagram showing the relationship between the anode current I1 and the gate voltage Vg, when the anode voltage Va is changed. As shown in FIG. 4, if the anode voltage is increased, Von and Voff shift to a low voltage. On the contrary, if the anode voltage is decreased, Von and Voff shift to a high voltage. However, the magnitude of the swing voltage Vswing (=Von−Voff) is not practically changed. This is because the field of the surface of the cathode electrode 2 (surface of the electron-emitting member 5) is determined by the "principle of superposition" of "a field created by the anode voltage" and the "field created by the gate voltage". That is, the anode voltage does not practically contribute to the magnitude of the swing voltage Vswing of the gate voltage.

According to the inventor of the present invention, for a reduction of the swing voltage Vswing, significant parameters are: (1) a ratio (Sg/Sc) of the area Sg of the gate electrode 3 to the area (area of the cathode electrode) Sc of the opening of the gate electrode; and (2) a ratio H/W of the above-described distance H and the width W of the opening. Note that the area Sg, the area Sc, the distance H and the width W are defined as above.

Below describes an example wherein the distance H corresponds to the thickness of the insulating layer 4, or the electron-emitting member 5 is formed of the electron-emitting film.

When the image display apparatus emits light, the luminance variation of its display screen is preferably restrained to 10% or lower (the minimum is 0%). To realize this, the variation of the magnitude of the swing voltage Vswing should be restrained to 10% or lower (the minimum is 0%), thereby substantially restraining the luminance variation. According to the inventor, in such a case, some necessary conditions are that: the area Sg of the gate electrode 3 is at least four times larger than the area Sc of the opening; and the ratio H/W of the distance H to the width W is restrained into a range not less than 0.07 but not more than 0.6.

To restrain the luminance variation of the display screen to 1% or lower (the minimum is 0%), the variation of the magnitude of the swing voltage Vswing needs to be retrained to 1% or lower (the minimum is 0%). According to the inventor, in this case, some necessary conditions are that: the area Sg of the gate electrode 3 is at least four times larger than the area Sc of the opening; and the ratio H/W of the distance H to the width W is restrained into a range not less than 0.2 but not more than 0.36.

<Structure for Decreasing Swing Voltage Vswing>

Figure 5:
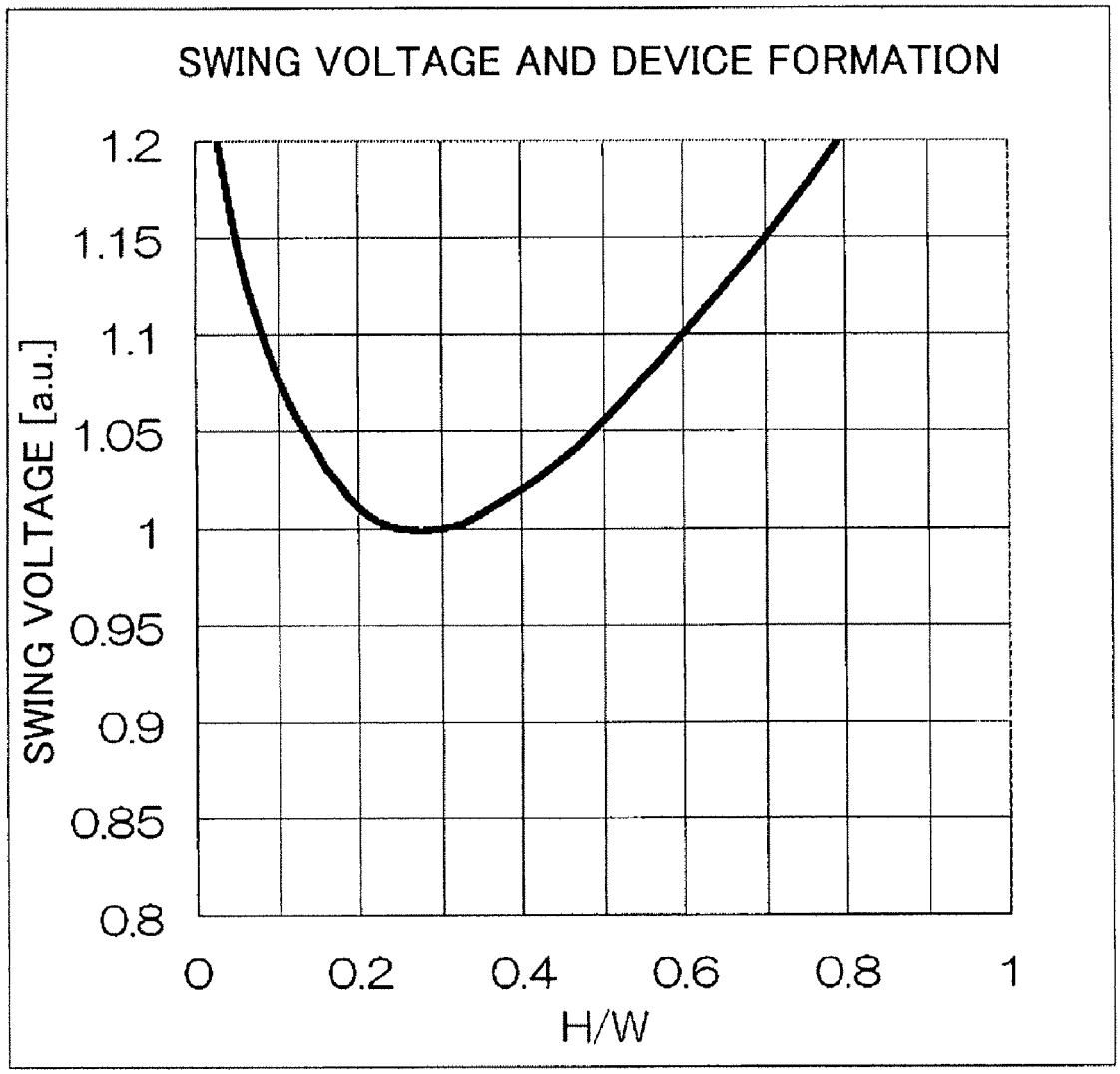
FIG. 5 is a diagram showing the relationship between a ratio H/W and a swing voltage.

The description will now be made to the structure for decreasing the absolute value of the swing voltage Vswing with reference to FIG. 5 and FIG. 6. FIG. 5 is an exemplary diagram showing a value of the swing voltage Vswing when the ratio H/W is changed. In FIG. 5, the vertical axis shows the relative value on the basis of the minimum value (set at 1) of the swing voltage Vswing.

When the ratio H/W is 1/3, it is obvious that the swing voltage Vswing tends to be the minimum value. If the H/W is set not less than 0.07 but not more than 0.6, the variation of the magnitude of the swing voltage Vswing can be restrained to 10% or lower (the minimum is 0%). Further, if the ratio H/W is set not less than 0.2 but not more than 0.36, the variation of the magnitude of the swing voltage Vswing can be restrained to 1% or lower (the minimum is 0%).

FIG. 5 shows an example wherein the area Sg of the gate electrode 3 is one hundred times larger than the area Sc of the opening. As long as the areas Sg and Sc are set in a practical range, the relationship shown in FIG. 5 can substantially be maintained even if the ratio of the areas Sg to Sc changes.

Figure 6:
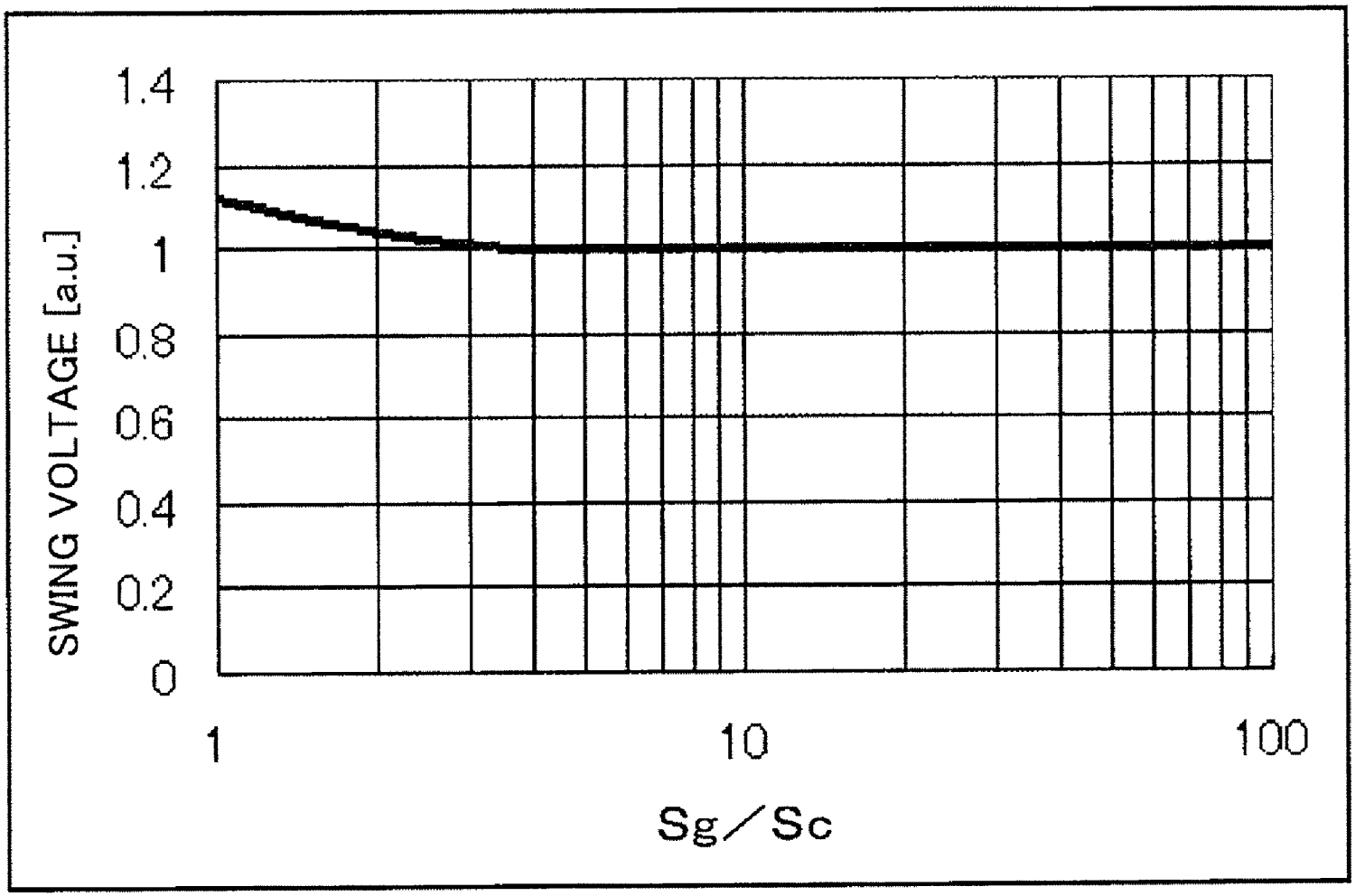
FIG. 6 is a diagram showing the relationship between a ratio Sg/Sc and the swing voltage Vswing.

FIG. 6 is an exemplary diagram showing the value of the swing voltage Vswing, when the ratio Sg/Sc ((area of the gate electrode 3)/(area of the opening)) is changed. In FIG. 6, the vertical axis shows the relative value on the basis of the minimum value (set at 1) of the swing voltage Vswing.

As obvious from FIG. 6, the ratio Sg/Sc is set at 4 or greater so as to minimize the swing voltage Vswing. The relationship shown in FIG. 6 can be obtained with a high level of repeatability as long as the ratio H/W is set in the practical range shown in FIG. 5, regardless of the absolute value of the areas Sg and Sc.

Therefore, the swing voltage Vswing can sufficiently be decreased at last, by setting the ratio H/W not less than 0.07 but not more than 0.6 (preferably, not less than 0.2 but not more than 0.36) and setting also the ratio Sg/Sc at 4 or greater.

The preferable relationship between the distance "h" from the anode electrode 6 to the gate electrode 3 and the distance "H" is:

$$h > H \times 100.$$

This is due to the effect, called a "field proximity effect". The distance between the anode electrode 6 and the gate electrode 3 may practically be in a range not less than 200 μm but not more than 100 mm (preferably not less than 1 mm but not more than 10 mm).

Figure 8:
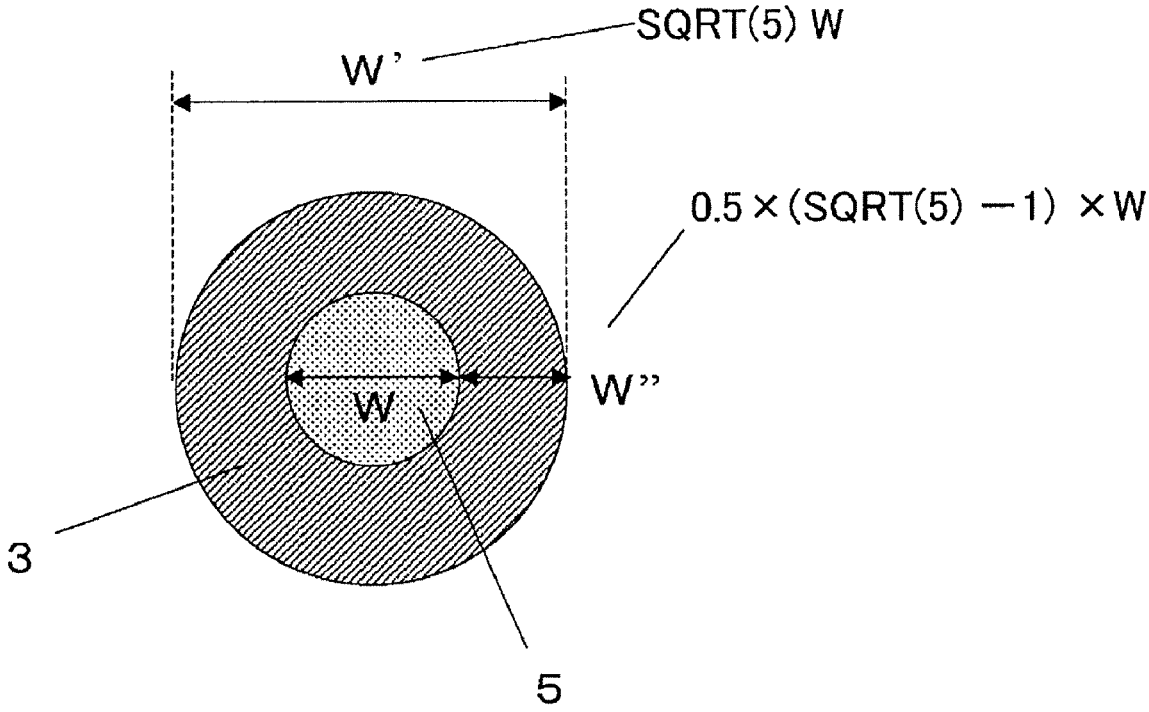
FIG. 8 is a diagram showing an example of layout in which the gate electrode has an area that is at least four times larger than that of the opening.
Figure 9:
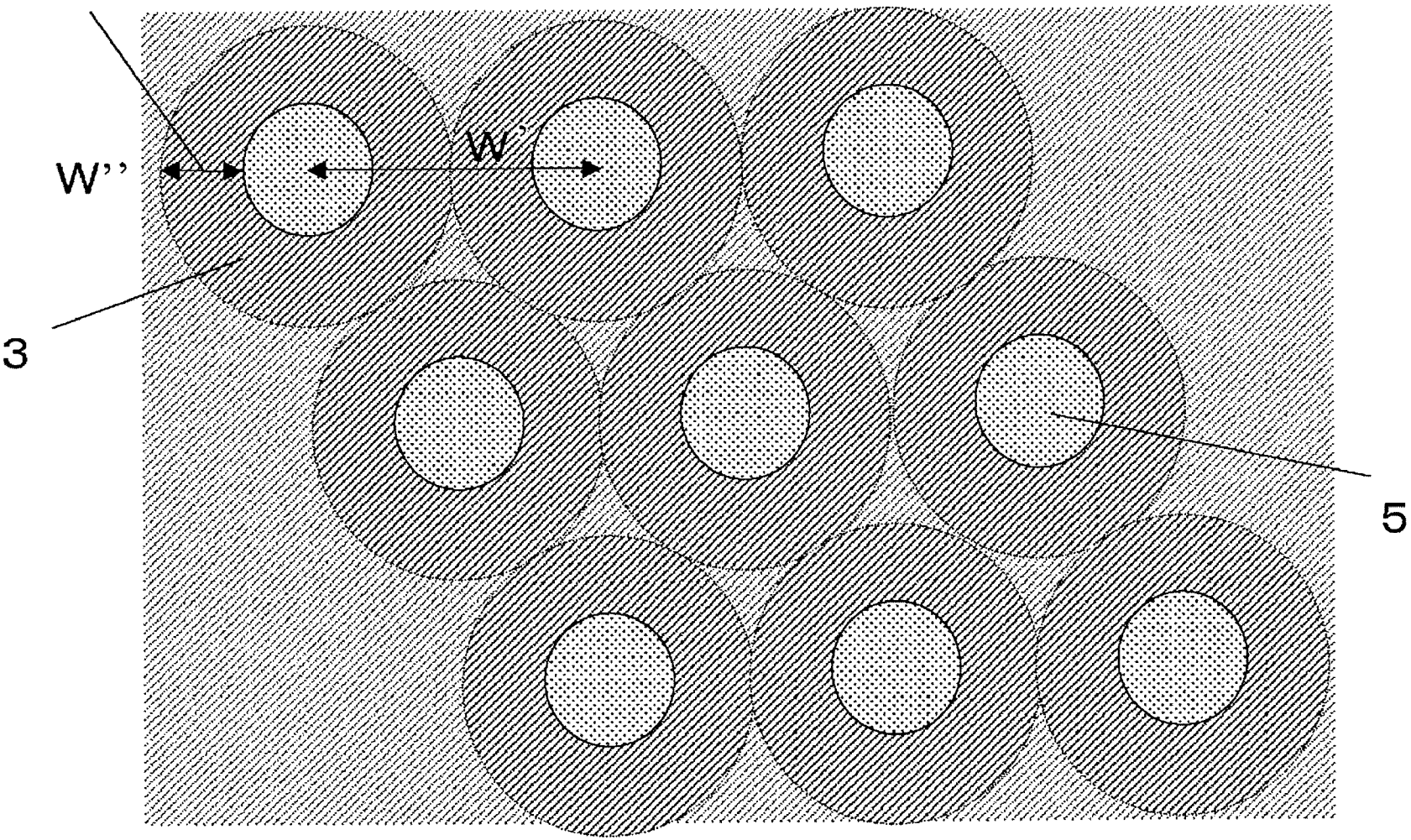
FIG. 9 is a diagram showing an example of layout in which the gate electrode has an area that is at least four times larger than that of the opening.
Figure 10:
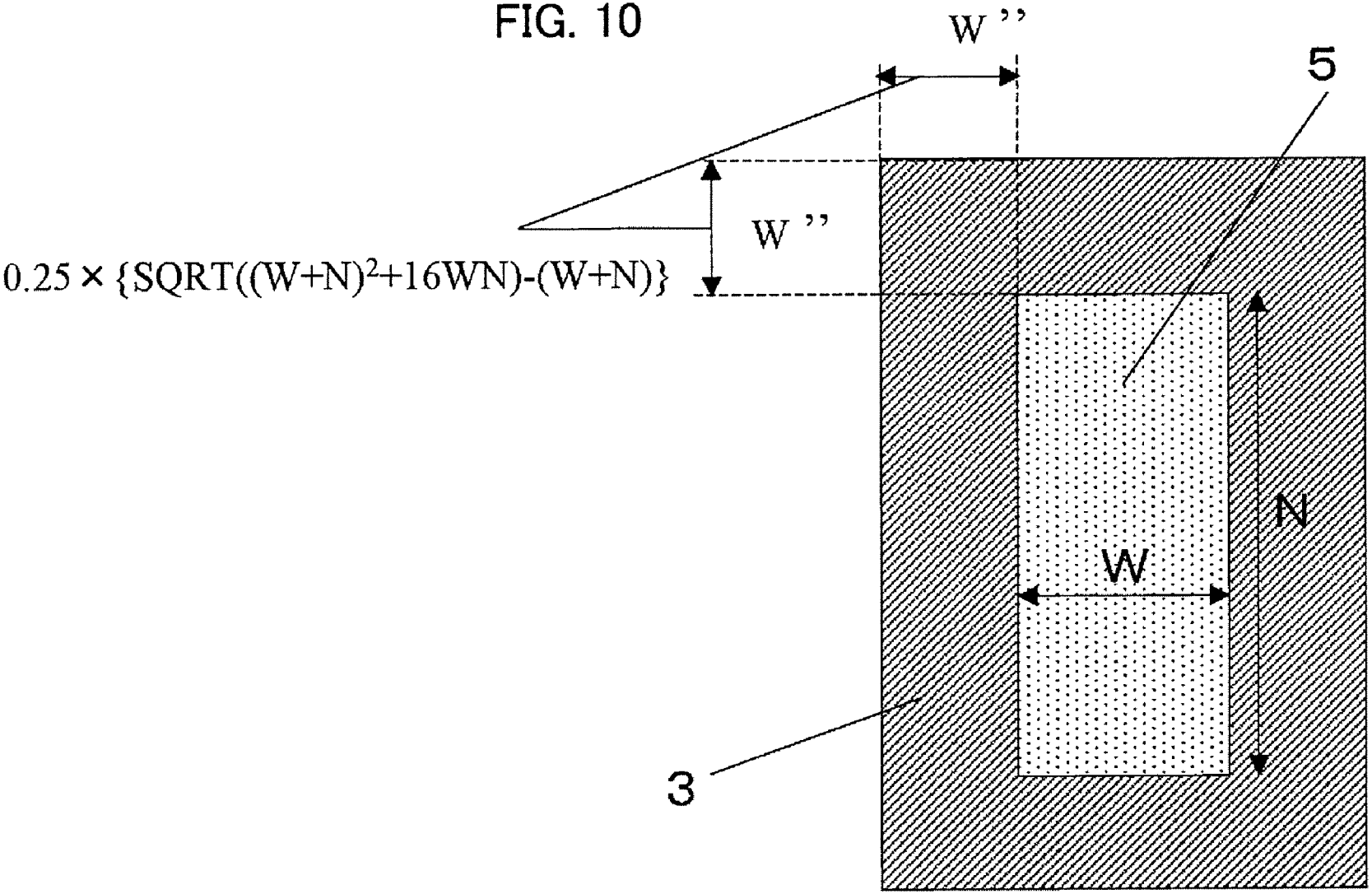
FIG. 10 is a diagram showing an example of layout in which the gate electrode has an area that is at least four times larger than that of the opening.

Each of FIG. 8 to FIG. 10 exemplarily shows an example of layout in which the area Sg of the gate electrode 3 is at least four times larger than the area Sc of the opening. Each of FIG. 8 and FIG. 9 shows the case wherein the gate electrode 3 has a circular opening in a plan view. FIG. 8 shows one single electron-emitting device including one single opening. In order to have an area that is at least four times larger than the area Sc of the opening, the gate electrode 3 may have a donut-like shape (a flat washer shape) having an opening in the center. To have the area Sg of the gate electrode 3 four times (or more than four times) greater than the area Sc of the opening, the diameter (external diameter) W' of the gate electrode 3 may be set at "$5^{1/2}\times W$" or greater. At this time, a larger area than a width W" ($0.5\times(5^{1/2}-1)\times W$) is formed entirely on the surrounding of the opening. In FIG. 8 to FIG. 10, formulas are shown with a function "SQRT( )" for obtaining the square root.

As shown in FIG. 9, when a plurality of electron-emitting devices are arranged, the diameter of the gate electrode 3 may be made equal to or greater than W', and the distance between the adjacent gate electrodes may be made equal to or greater than W'. As long as these conditions are satisfied, the gate electrodes may be formed from a series of electrodes. That is, one single electron-emitting device (single gate electrode) may include a plurality of openings shown in FIG. 9.

To form the area of the gate electrode 3 that is four times larger than the area of the opening when the cathode electrode 2 (opening) is made in an oval form, the minimum width W" of the gate electrode 3 may be equal to or greater than $$0.25\times\{-(a+W)+(a^2+W^2+18aW)^{1/2}\},$$

where "a" expresses the major diameter of the oval, and W expresses the minor diameter thereof.

FIG. 10 shows the case wherein the gate electrode 3 has a rectangular opening in a plan view. FIG. 10 shows the case wherein a symbol N denotes the length in the longitudinal direction of the opening of the gate electrode 3, and a symbol W denotes the length in the short-side direction thereof (width of the opening). To form the area Sg of the gate electrode 3 that is four times larger than the area Sc of the opening, the gate electrode 3 may be arranged as shown in FIG. 10. That is, the minimum width W" of the gate electrode 3 may be equal to or greater than $$0.25\times\{((W+N)^2+16WN)^{1/2}-(W+N)\}.$$

To form the area Sg of the gate electrode 3 that is four times larger than the area Sc of the opening when the opening is made in a square form, the minimum width W" of the gate electrode 3 may be equal to or greater than $$0.25\times\{(20W^2)^{1/2}-2W\},$$

where W=N.

<Method of Manufacturing Electron-Emitting Device>

An example of a method of manufacturing the above-described electron-emitting device of the present invention will now be explained with reference to FIG. 1A, FIG. 1B and FIG. 7A to FIG. 7E. FIG. 7A to FIG. 7E are diagrams each for explaining an example of a method of manufacturing the electron-emitting device according to the first embodiment. Those materials, dimensions or variants of the components can commonly and preferably be used for the electron-emitting devices according to both the first and second embodiments, as will be described below.

The substrate can be formed of silica glass, glass having a reduced impurity content (Na, etc.), a soda lime glass, a laminated member having $SiO_2$ layer laminated on a silicon substrate using a sputtering method or the like, or a ceramic insulating component (such as alumina, etc.). Before laminating $SiO_2$, the surface of the substrate should be cleaned enough.

The cathode electrode (first electrode) 2 may be formed of a conductor having conductivity. The cathode electrode 2 may be formed on the substrate using a general vacuum film deposition technique (e.g. vapor deposition, sputtering, etc.) or a photolithography technique. The cathode electrode 2 may be formed of a metal material, such as Be, Mg, Ti, Zr, Hf, V, Nb, Ta, Mo, W, Al, Cu, Ni, Cr, Au, Pt, Pd, or may be formed of an alloy thereof. In addition, the electrode may be formed of a carbide (e.g. TiC, ZrC, HfC, TaC, SiC, WC, etc.), a boride (e.g. $HfB_2$, $ZrB_2$, $LaB_6$, $CeB_6$, $YB_4$, $GdB_4$, etc.), or a nitride (TiN, ZrN, HfN, etc.). The cathode electrode 2 is practically set to have a thickness in a range not less than 1 nm but not more than 100 μm, more preferably in a range not less than 10 nm but not more than 10 μm. The cathode electrode 2 may be a conductor (as long as it is not an insulator) supplying the electron-emitting member 5 with an electron, or may be so-called a current limiting resistor. In this case, the resistor may be formed of materials having resistibility in a range not less than $10^2$ but not more than $10^8\Omega\cdot$cm. Though not illustrated, the cathode electrode 2 may includes a current limiting resistive layer on its surface (i.e. between its surface and the electron-emitting member 5).

After the cathode electrode 2, the insulating layer 4 is laminated. The insulating layer 4 is formed using a general vacuum film deposition technique, such as a sputtering method, a CVD method, vacuum vapor deposition, etc. The insulating layer 4 has a thickness practically in a range not less than 10 nm but not more than 100 μm, and may be set preferably in a range not less than 10 nm but not more than 5 μm. The insulating layer 4 is preferably formed of a material (e.g. $SiO_2$, SiN, $Al_2O_3$, CaF, undoped diamond) having a high withstand voltage so as to withstand a high electric field.

Figure 7A:
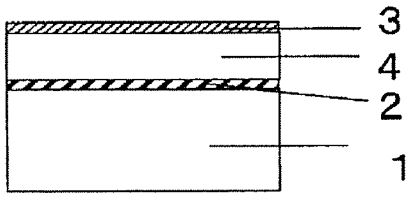
FIG. 7A to FIG. 7E are diagrams for explaining an example of a method of manufacturing the electron-emitting device according to the first embodiment.

As shown in FIG. 7A, the gate electrode (second electrode) 3 is laminated on the insulating layer 4. The gate electrode 3 may be formed of a conductor having conductivity, like the cathode electrode 2. The gate electrode 3 may be formed using a general vacuum film deposition technique (such as vapor deposition, sputtering method, etc.), or a photolithography technique. The gate electrode 3 may be formed of a metal material, such as Be, Mg, Ti, Zr, Hf, V, Nb, Ta, Mo, W, Al, Cu, Ni, Cr, Au, Pt, Pd, or may be formed of an alloy thereof. In addition, the gate electrode 3 may be formed of a carbide (e.g. TiC, ZrC, HfC, TaC, SiC, WC, etc.), a boride (e.g. $HfB_2$, $ZrB_2$, $LaB_6$, $CeB_6$, $YB_4$, $GdB_4$, etc.), or a nitride (TiN, ZrN, HfN, etc.). The gate electrode 3 has a thickness practically in a range not less than 1 nm but not more than 100 μm, and may be set preferably in a range not less than 10 nm but not more than 10 μm.

The cathode electrode 2 and the gate electrode 3 may be formed of the same materials or different materials. The cathode electrode 2 and the gate electrode 3 may be formed using the same or different deposition method.

Figure 7B:
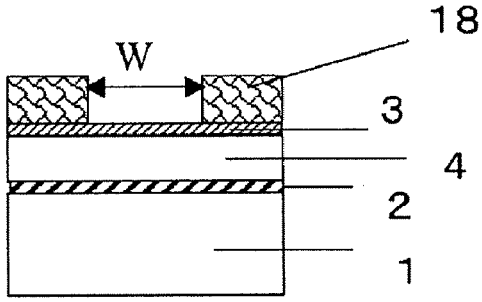

As shown in FIG. 7B, a mask pattern 18 is formed using a photolithography technique.

Figure 7C:
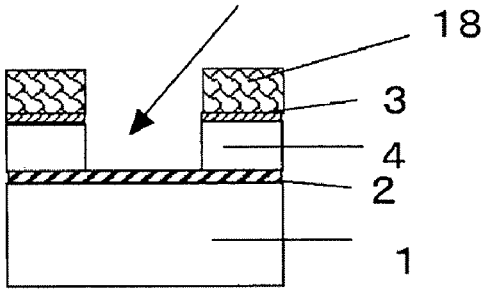

As shown in FIG. 7C, the insulating layer 4 and the gate electrode 3 are etched so as to partially be removed therefrom so as to form an opening 100. In this etching process, the etching may be finished at the time the surface of the cathode electrode 2 is exposed, or the etching may go on until the surface of the cathode electrode 2 is slightly etched. The etching may be processed in accordance with the materials of the insulating layer 4 and the gate electrode 3.

Figure 7D:
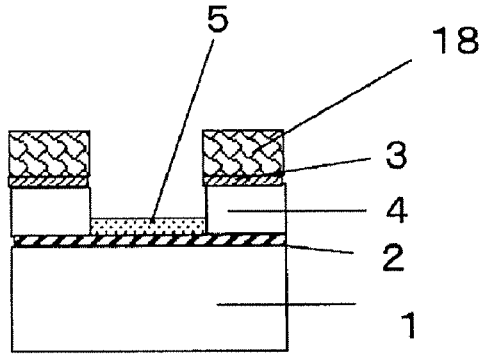

Subsequently, as shown in FIG. 7D, the electron-emitting member 5 is deposited on the cathode electrode 2 inside the opening 100. The electron-emitting member 5 is formed using a general vacuum film deposition technique (such as vapor deposition, a sputtering method, etc.) or a photolithography technique. The electron-emitting member 5 may be formed of an adequate material from amorphous carbon, graphite, fullerene, a carbon nano-tube, a graphite nano-fiber, diamond-like carbon, a diamond particle and a conductive particle. Preferably, a low work function diamond or diamond-like carbon is used. In addition, a carbon fiber (typically a carbon nano-tube, etc.) which can easily emit electrons in a low field may preferably be used. Like the second embodiment, when the electron-emitting member 5 is made in the form of a film (in the case of the above-described electron-emitting film), its thickness is set practically in a range not less than 1 nm but not more than 10 μm, and preferably in a range not less than 10 nm but not more than 1 μm. In the second embodiment, the electron-emitting film may be composed of various types of carbon films (such as a CVD diamond film, a diamond-like carbon film, a graphite film, an amorphous carbon film, an hydrogenated carbon film, a tetrahedral amorphous carbon film and a film containing sp2 bonding structure and sp3 bonding structure).

If the carbon fiber or conductive particle is used, the electron-emitting member 5 can be composed of a plurality of electron emitters, as described in the first embodiment. Each of the electron emitters may be formed of one single carbon fiber (one conductive particle), or each of the electron emitters may be formed of an aggregate of carbon fibers (a plurality of conductive particles). When the carbon fibers (preferably a plurality of carbon fibers) are used, they may preferably be oriented substantially in a direction from the first electrode 2 to the anode electrode 6.

The carbon fiber can be formed by decomposing a hydrocarbon gas using a catalyst. For example, a plurality of catalyst particles are arranged on the first electrode 2, thereby forming the carbon fiber on the first electrode 2 using a thermal CVD method.

The catalyst may preferably be any of Fe, Co, Pd, Ni, or may be an alloy of some of these materials.

Finally, as shown in FIG. 7D, the mask pattern 18 is removed so as to complete the electron-emitting device.

Below describes the application of the electron-emitting device of the present invention.

A plurality of electron-emitting devices of the present invention are arranged on the substrate, thereby forming an electron source and further forming an image display apparatus using this electron source.

<Electron Source>

Figure 11:
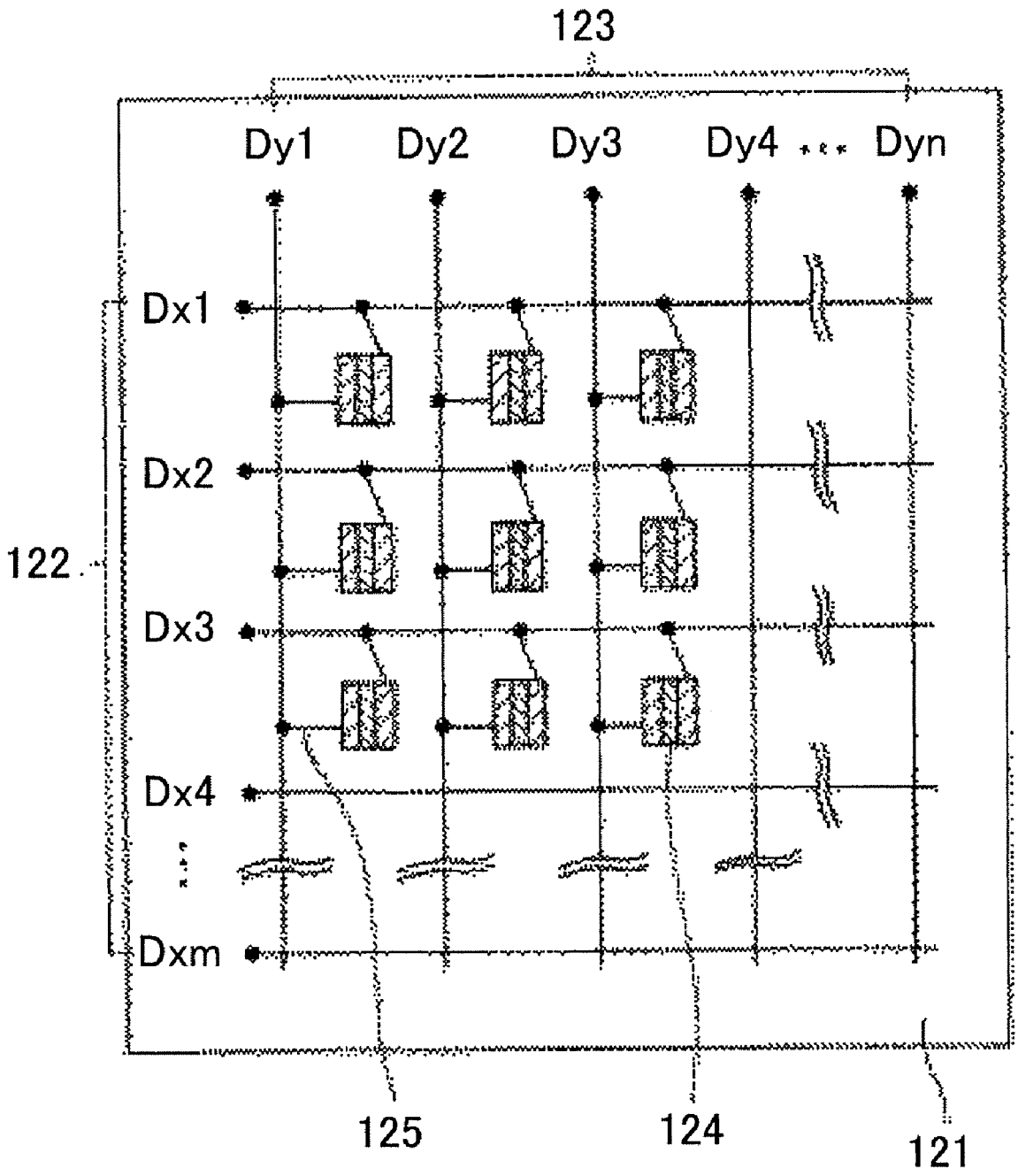
FIG. 11 is a diagram showing an electron source including a plurality of electron-emitting devices arranged therein.

FIG. 11 is an exemplary diagram showing the electron source which can be formed by arranging a plurality of electron-emitting devices 124. The electron source includes a substrate 121, X-direction wirings 122, Y-direction wirings 123, the electron-emitting devices 124 and connections 125.

The X-direction wirings 122 are composed of "m" pieces of wirings, Dx1, Dx2, . . . Dxm. These wirings can be formed of conductive metal using a vacuum vapor deposition method, a printing method, a sputtering method, etc. The materials, thickness and width of the wirings are designed properly. The Y-direction wirings 123 are composed of "n" pieces of wirings, Dy1, Dy2, . . . Dyn. The Y-direction wirings 123 are formed like the X-direction wirings 122. A non-illustrated interlayer insulating layer is arranged between the m pieces of X-direction wirings 122 and the n pieces of the Y-direction wirings 123. The interlayer insulating layer electrically disconnects the X-direction wirings 122 and the Y-direction wirings 123. Note that both "m" and "n" are positive integers, The interlayer insulating layer is made of $SiO_2$ using a vacuum vapor deposition method, a printing method, a sputtering method, etc. The interlayer insulating layer is so designed with an appropriate thickness, materials and manufacturing method as to withstand the potential difference at the cross point of the X-direction wirings 122 and the Y-direction wirings 123. The X-direction wirings 122 and the Y-direction wirings 123 are withdrawn as external terminals. For example, the X-direction wirings 122 are connected to the scanning circuit 403 shown in FIG. 14. The Y-direction wirings 123 are connected to the modulation circuit 402 shown in FIG. 14. A drive voltage to be applied to each of the electron-emitting devices 124 is supplied as a differential voltage of a scan signal from the scanning circuit 403 and a modulation signal from the modulation circuit 402. These signals are to be applied to the electron-emitting device.

The above-described first electrode 2 included in each electron-emitting device 124 is connected to one of the m pieces of X-direction wirings 122. The above-described second electrode 3 included in each electron-emitting device 124 is connected to one of the n pieces of Y-direction wirings 123.

The X-direction wirings 122, the Y-direction wirings 123, the first electrode 2 and the second electrode 3 may be made of the partially or entirely the same components, or may be made of different components therebetween. When the materials of the electrode of the electron-emitting device are the same as those of the wirings, there is no clear distinction between the X-direction wirings 122 and the first electrode 2 and also between the Y-direction wirings 123 and the second electrode 3. That is, the first electrode 2 and the second electrode 3 both function as wirings.

In the above-described structure, the electron-emitting devices can individually be selected and also independently be driven, using the simple matrix wiring structure. An image display apparatus including the electron source having this simple matrix arrangement will now be described with reference to FIG. 12.

<Display Panel>

Figure 12:
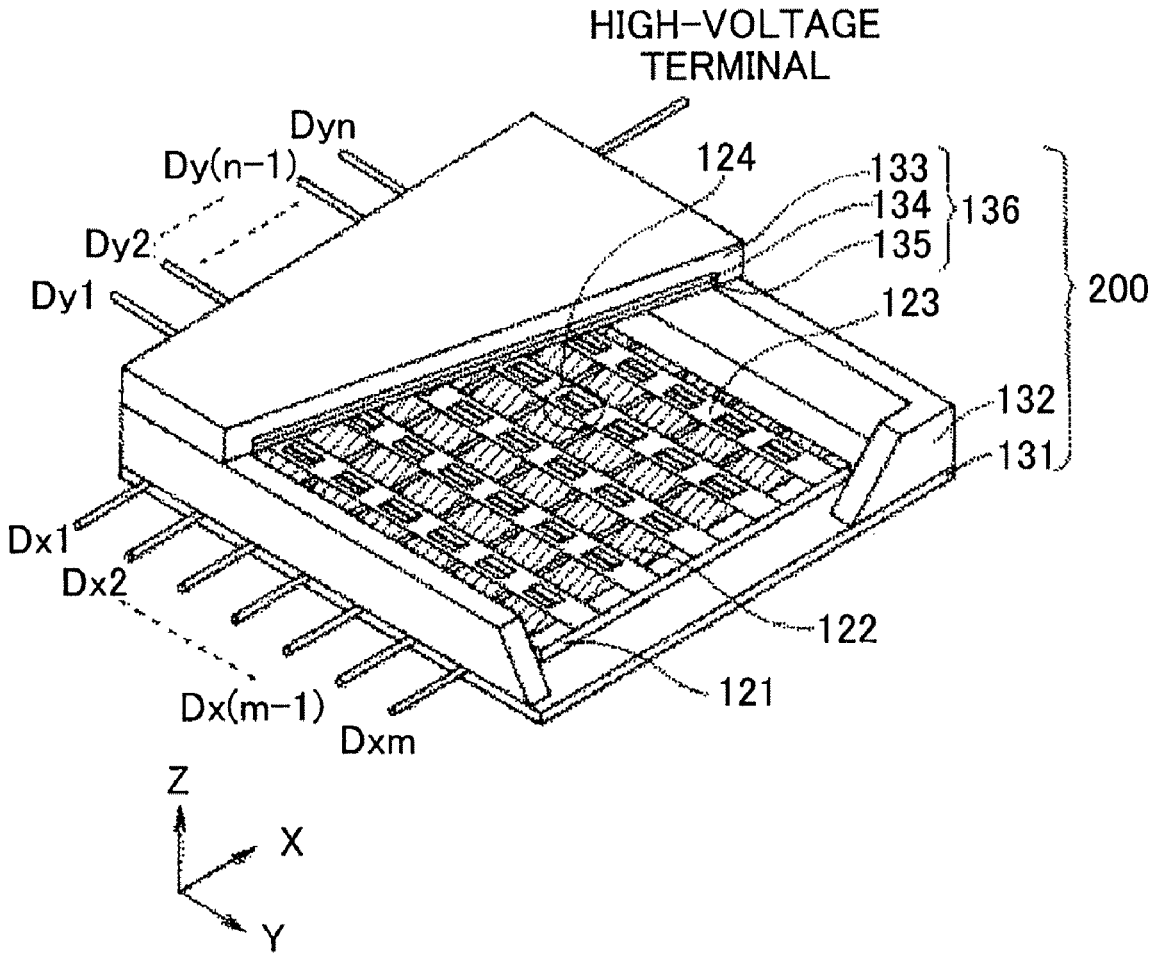
FIG. 12 is an exemplary diagram showing an example of a display panel of an image display apparatus.

FIG. 12 is an exemplary diagram showing an example of the display panel 200 using the electron source.

In FIG. 12, the substrate 121 on which a plurality of electron-emitting devices are arranged is fixed onto a rear plate 131. A phosphor film 134 as a luminescent member and a metal back 135 are provided inside a glass substrate 133 so as to form a face plate 136. The metal back 135 includes a function of the above-described anode electrode 6. The metal back 135 is set to have a thickness which is equal to or less than the thickness through which an electron emitted from the electron-emitting device can transmit. The metal back 135 is typically formed from an aluminum film. The rear plate 131 and the face plate 136 are adhered onto a supporting frame 132 with adhesives, such as a frit glass, indium, etc.

A surrounding unit (display panel) 200 includes the faceplate 136, the supporting frame 132 and the rear plate 131. The rear plate 131 is provided mainly for the purpose of strengthening the substrate 121. Thus, if the substrate 121 itself is strong enough, the rear plate 131 is not necessary. That is, the supporting frame 132 may be directly attached to the substrate 121, while the surrounding unit 200 may be composed of the faceplate 136, the supporting frame 132 and the substrate 121. A non-illustrated supporter, called a spacer, can be arranged between the faceplate 136 and the rear plate 131, thereby forming the surrounding unit 200 that is strong enough at atmospheric pressure.

If this display panel 200 is used as one for the television apparatus described with reference to FIG. 13, a television with a very small depth can be formed.

EXAMPLES

Below describes the electron-emitting device of the present invention based on some examples.

Example 1

In this example, the description will now be made to the electron-emitting device including the circular gate electrode 3 and a circular opening shown in FIG. 8. The cross sectional view of this device has the same structure as that shown in FIG. 1A.

With reference to FIG. 7A to FIG. 7E, the description will now be made to a method of manufacturing the electron-emitting device of the present example. FIG. 7A to FIG. 7E and FIG. 8 show the case wherein the one electron-emitting device includes one single cathode electrode. In this example, a plurality of electron-emitting devices are formed as shown in FIG. 9. In fact, one thousand cathode electrodes 2 are arranged, and the swing voltage Vswing is measured and evaluated. The distance W' between the centers of the openings is equal to or greater than 30 μm. As shown in FIG. 9, the width W" of the area around the opening is equal to or greater than 10 μm.

As described in the above embodiments, when the area Sg of the gate electrode 3 is set at least four times larger than the area Sc of the opening, the minimum swing voltage Vswing will be obtained. Thus, in this example, the width W of the opening is set at 10 μm, the distance W' between the cathode electrodes 2 is set at 30 μm ($>5^{1/2}\times W=22.3$ μm), and the width W" of the gate electrode 3 is set at 10 μm ($>0.5\times(5^{1/2}-1)\times W=6.2$ μm).

(Process 1)

First, a laminated member shown in FIG. 7A is formed. A silica glass is used as the substrate, and cleaned enough. Then, on the substrate, Al having a thickness of 100 nm is laminated as the cathode electrode 2, $SiO_2$ having a thickness of 3000 nm is laminated as the insulating layer 4, and Ta having a thickness of 100 nm is laminated as the gate electrode 3, in a sequential manner using a sputtering method.

(Process 2)

As shown in FIG. 7B, the mask pattern 18 is formed using a photolithography, that is, by spin-coating a positive-type photoresist (AZ1500/Clariant Co.), exposing the photo mask pattern, and developing. The diameter W of the opeing of the mask pattern 18 is set at 10 μm.

As shown in FIG. 7C, the insulating layer 4 and the gate electrode 3 are dry-etched using $CF_4$ gas and the mask pattern 18 as a mask. At this time, this etching ends on the surface of the cathode electrode 2. By this process, the opening 100 penetrating the gate electrode 3 and the insulating layer 4 can be formed. As a result, the gate electrode 3 (and the insulating layer 4) now has the opening 100 having the diameter (W) of 10 μm.

(Process 3)

Subsequently, as shown in FIG. 7D, a diamond-like carbon film is deposited into a thickness of 100 nm on the cathode electrode 2 inside the opening 100, as the electron-emitting member 5, using a CVD (Chemical Vapor Deposition) method. This diamond-like carbon film is a continuous film, and the distance H defines the above-described latter distance. That is, in this case, the first electrode 2 inside the opening 100 is covered with the diamond-like carbon film 5. Thus, the distance H can be defined as the shortest distance between the electron-emitting film 5 and the second electrode 3 inside the opening 100.

Figure 7E:
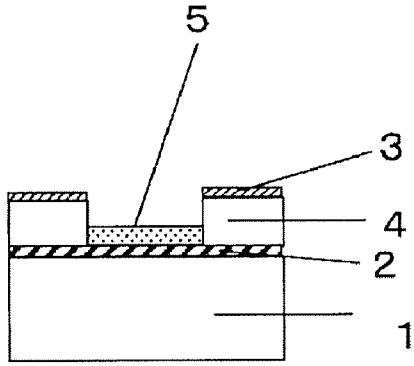

Finally, the mask pattern 18 that has been used as a mask is completely removed so as to complete the electron-emitting device of this example shown in FIG. 7E.

An electron is emitted using the plurality of electron-emitting devices that have been created according to the above processes and are arranged as shown in FIG. 9. The anode voltage Va is equal to 5 kV (Va=5 kV), and the distance H between the electron-emitting member 5 and the anode electrode 6 is set at 2 mm.

A symbol Ion denotes that the anode current I1 is $10^{-6}$ A, and a symbol Ioff denotes that the anode current I1 is $10^{-9}$ A or lower. The minimum value of the swing voltage Vswing is approximately 12.9V. At this time, the gate voltage Von is 20.8V when the current is Ion, while the gate voltage Voff is 7.8V when the current is Ioff.

Table 1 shows the variation of the swing voltage Vswing, when the width W is fixed at the value of 10 μm and the distance H is set at 0.1 μm, 0.7 μm, 1 μm, 2 μm, 3 μm, 3.6 μm, 6 μm, 8 μm and 10 μm.

TABLE 1

| H | Von (V) | Voff (V) | Swing Voltage (V) |
|---|---|---|---|
| 0.1 μm | 17.6 | 0.5 | 17.1 |
| 0.7 μm | 17.8 | 2.7 | 15.1 |
| 1 μm | 18.1 | 3.6 | 14.5 |
| 2 μm | 19.2 | 5.9 | 13.3 |
| 3 μm | 20.8 | 7.8 | 13.0 |
| 3.6 μm | 21.9 | 8.9 | 13.1 |
| 6 μm | 26.9 | 12.9 | 14.1 |
| 8 μm | 31.3 | 15.9 | 15.4 |
| 10 μm | 35.9 | 18.9 | 17.0 |

The diameter of the cathode electrode W = 10 μm.

The minimum swing voltage Vswing is obtained, when the distance H is 3 μm (H/W=0.3). When the ratio H/W is in the range "not less than 0.07 but not more than 0.6", the swing voltage Vswing is lower than that at other conditions.

Accordingly, the minimum swing voltage Vswing can be obtained, when the width W and the distance H are so set that the ratio H/W is not less than 0.07 but not more than 0.6.

Example 2

In this example, the swing voltage Vswing has been measured, while the width W is fixed at 30 μm. Because the method of manufacturing the electron-emitting device is the same as that of Example 1, the description of the method will not herein be repeated.

Conditions for driving the electron-emitting device are: that the anode voltage Va is equal to 5 kV (Va=5 kV); and the distance h between the second electrode 3 and the anode electrode 6 is set at 2 mm. By the way, these conditions are the same as those of Example 1.

A symbol Ion denotes that the anode current I1 is $10^{-6}$ A, a symbol Ioff denotes that the anode current I1 is equal to or lower than $10^{-9}$ A, a symbol Von denotes the gate voltage when the current is Ion, and a symbol Voff denotes the gate voltage when the current is Ioff.

Table 2 shows the variation of the swing voltage Vswing, when the distance H is set at 0.3 μm, 2.1 μm, 3 μm, 6 μm, 9 μm, 10.8 μm, 18 μm, 24 μm and 30 μm.

TABLE 2

| H | Von (V) | Voff (V) | Swing Voltage (V) |
|---|---|---|---|
| 0.3 μm | 52.8 | 1.4 | 51.4 |

TABLE 2-continued

| H | Von (V) | Voff (V) | Swing Voltage (V) |
|---|---|---|---|
| 2.1 μm | 53.5 | 8.1 | 45.4 |
| 3 μm | 54.2 | 10.7 | 43.5 |
| 6 μm | 57.7 | 17.8 | 39.9 |
| 9 μm | 62.3 | 23.5 | 38.9 |
| 10.8 μm | 65.6 | 26.6 | 39.0 |
| 18 μm | 80.8 | 38.6 | 42.2 |
| 24 μm | 94.0 | 47.8 | 46.2 |
| 30 μm | 107.8 | 56.8 | 51.1 |

The diameter of the cathode electrode W = 30 μm.

The width W is set at 30 μm in Example 2, while the width has been set at 10 μm in Example 1. Thus, the absolute values of the gate voltage Von, Voff and the swing voltage Vswing have become three times greater than those of Example 1 in accordance with the corresponding designed scales.

The minimum swing voltage Vswing is obtained, when the distance H is 9 μm, that is, the ratio H/W is 0.3. When the ratio H/W is in the rage not less than 0.07 but not more than 0.6, the swing voltage Vswing is lower than that at other conditions. As seen from the ratio H/W, the minimum swing voltage Vswing can be obtained under the same condition as that of Example 1.

Accordingly, a very low swing voltage Vswing can be obtained, when the ratio of the width W to the distance H is set in the range not less than 0.07 but not more than 0.6.

Example 3

In Example 3, an electron source and an image display apparatus can be created using the above-described electron-emitting device.

Electron-emitting devices are arranged in matrix of 10×10. In this wiring structure, the X-direction wiring is connected to the cathode electrode 2, while Y-direction wiring is connected to the gate electrode 3, as shown in FIG. 11. The electron-emitting devices are arranged at a pitch of 150 μm in width and 300 μm in length. The anode electrode 6 including a phosphor is arranged above each electron-emitting device at a distance 2 mm away therefrom. A voltage of 10 kV is applied to the anode electrode 6. This structure results in the refined image display apparatus and electron source capable of performing matrix driving, while maintaining a high level of consistency and long-term stability.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-068877, filed Mar. 14, 2006, which is hereby incorporated by reference herein in its entirety.

What is claimed is:

1. An electron-emitting device comprising:

(A) a first electrode;

(B) an electron-emitting film which is provided on said first electrode; and (C) a second electrode which is provided above said electron-emitting film at a distance H1 from an upper surface of said electron-emitting film, and includes an opening which exposes at least a part of said electron-emitting film, wherein an area of said second electrode is at least four times larger than an area of said opening, and a ratio H1/W of said distance H1 to a width W of said opening is not less than 0.07 but not more than 0.6.

2. An electron-emitting device comprising:

(A) a first electrode;

(B) a plurality of electron emitters which are provided on said first electrode; and (C) a second electrode which is provided above said first electrode at a distance H2 from an upper surface of said first electrode, and includes an opening which exposes at least a part of said first electrode and at least a part of said plurality of electron emitters, wherein an area of said second electrode is at least four times larger than an area of said opening, and a ratio H2/W of said distance H2 to a width W of said opening is not less than 0.07 but not more than 0.6.

3. The electron-emitting device according to claim 1, further comprising an insulating layer between said first electrode and said second electrode.

4. The electron-emitting device according to claim 2, further comprising an insulating layer between said first electrode and said second electrode.

5. The electron-emitting device according to claim 1, wherein the ratio H1 of the distance H1 to the width W of the opening is not less than 0.2 but not more than 0.36.

6. The electron-emitting device according to claim 2, wherein the ratio H2/W of the distance H2 to the width W of the opening is not less than 0.2 but not more than 0.36.

7. The electron-emitting device according to claim 1, wherein said opening has a circular form, and a relationship between the width W representing a diameter of the opening and a width W" of said second electrode around the opening is $$W''>(5^{1/2}-1)/2\times W.$$

8. The electron-emitting device according to claim 2, wherein said opening has a circular form, and a relationship between the width W representing a diameter of the opening and a width W" of said second electrode around the opening is $$W''>(5^{1/2}-1)/2\times W.$$

9. The electron-emitting device according to claim 1, wherein said opening has a oval form, and a relationship between a major diameter "a" of the opening, a minor diameter W thereof and a width W" of said second electrode around the opening is $$W''>0.25\times\{-(a+W)+(a^2+W^2+18aW)^{1/2}\}.$$

10. The electron-emitting device according to claim 2, wherein said opening has a oval form, and a relationship between a major diameter "a" of the opening, a minor diameter W thereof and a width W" of said second electrode around the opening is $$W''>0.25\times\{-(a+W)+(a^2+W^2+18aW)^{1/2}\}.$$

11. The electron-emitting device according to claim 1, wherein said opening has a rectangular form, and a relationship between a length N in a longitudinal direction of the opening, a width W in a short-side direction thereof and a width W" of said second electrode around the opening is $$W''>0.25\times\{((N+W)^2+16W'N)^{1/2}-(W+N)\}.$$

12. The electron-emitting device according to claim 2, wherein said opening has a rectangular form, and a relationship between a length N in a longitudinal direction of the opening, a width W in a short-side direction thereof and a width W" of said second electrode around the opening is $$W''>0.25\times\{((N+W)^2+16W\times N)^{1/2}-(W+N)\}.$$

13. The electron-emitting device according to claim 1, wherein said opening has a square form, a relationship between a width W of one side of the opening and a width W" of said second electrode around the opening is $$W''>0.25\times\{(20W^2)^{1/2}-2W\}.$$

14. The electron-emitting device according to claim 2, wherein said opening has a square form, a relationship between a width W of one side of the opening and a width W" of said second electrode around the opening is $$W''>0.25\times\{(20W^2)^{1/2}-2W\}.$$

15. The electron-emitting device according to claim 1, wherein said electron-emitting film includes carbon or a carbon compound.

16. The electron-emitting device according to claim 2, wherein each of said electron emitters includes carbon or a carbon compound.

17. The electron-emitting device according to claim 15, wherein the carbon or the carbon compound includes at least any one of diamond-like carbon, graphite, diamond, a carbon nano-tube, a graphite nano-fiber and fullerene.

18. The electron-emitting device according to claim 16, wherein the carbon or the carbon compound includes at least any one of diamond-like carbon, graphite, diamond, a carbon nano-tube, a graphite nano-fiber and fullerene.

19. An electron source comprising:

a plurality of electron-emitting devices; and a wiring for commonly connecting said plurality of electron-emitting devices, wherein each of said electron-emitting devices is the electron-emitting device according to claim 1.

20. An electron source comprising:

a plurality of electron-emitting devices; and a wiring for commonly connecting said plurality of electron-emitting devices, wherein each of said electron-emitting devices is the electron-emitting device according to claim 2.

21. An image display apparatus comprising:

the electron source according to claim 19;

a third electrode which faces said electron source; and a luminescent member which is arranged on a side of said third electrode.

22. An image display apparatus comprising:

the electron source according to claim 20;

a third electrode which faces said electron source; and a luminescent member which is arranged on a side of said third electrode.

23. A television apparatus comprising:

the image display apparatus according to claim 21; and a receiving unit which receives a television signal and outputs image data to said image display apparatus.

24. A television apparatus comprising:

the image display apparatus according to claim 22; and a receiving unit which receives a television signal and outputs image data to said image display apparatus.

* * * * *